US007631372B2

(12) United States Patent
Marty et al.

(10) Patent No.: US 7,631,372 B2
(45) **Date of Patent: *Dec. 15, 2009**

(54) METHOD AND APPARATUS FOR PROVIDING STRAIN RELIEF OF A CABLE

(75) Inventors: Garry Robin Marty, Fishers, IN (US); Jeffrey Lee Moore, Frankfort, IN (US); Timothy Jay Sailors, Jr., Fishers, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 491 days.

This patent is subject to a terminal disclaimer.

(21) Appl. No.: 11/325,284

(22) Filed: Jan. 4, 2006

(65) Prior Publication Data

US 2006/0202142 A1 Sep. 14, 2006

Related U.S. Application Data

(60) Provisional application No. 60/662,107, filed on Mar. 14, 2005.

(51) Int. Cl.
*E03C 1/05* (2006.01)

(52) U.S. Cl. ..... 4/623; 24/129 A; 251/129.01

(58) Field of Classification Search ..... 251/129.04, 251/129.03, 129.01; 4/677, 302–305, 623; 137/801; 439/469; 24/129 R, 129 A, 130
See application file for complete search history.

(56) References Cited

U.S. PATENT DOCUMENTS 757,765 A * 4/1904 Osborne ..... 174/164
1,889,113 A * 11/1932 Shope ..... 24/131 R
4,688,277 A * 8/1987 Kakinoki et al. ..... 4/623
4,845,316 A * 7/1989 Kaercher ..... 174/135
4,998,673 A 3/1991 Pilolla
5,073,991 A 12/1991 Marty
5,224,509 A 7/1993 Tanaka et al.
5,555,912 A 9/1996 Saadi et al.
5,566,702 A 10/1996 Philipp
5,758,688 A 6/1998 Hamanaka et al.
5,918,855 A 7/1999 Hamanaka et al.
5,934,325 A 8/1999 Brattoli et al.

(Continued)

FOREIGN PATENT DOCUMENTS

DE 3339849 5/1985

(Continued)

OTHER PUBLICATIONS

Toto® Products, "Self-Generating EcoPower System Sensor Faucet, Standard Spout," Specification Sheet, Nov. 2002, 2 pgs.

(Continued)

*Primary Examiner*—John K Fristoe, Jr.
*Assistant Examiner*—Marina Tietjen
(74) *Attorney, Agent, or Firm*—Baker & Daniels LLP

(57) ABSTRACT

An electronic faucet includes a spout assembly having a sensor configured to control the flow of water therethrough in response to the position of a spray head. Methods and apparatus for providing strain relief for electrical cables used in systems configured to provide fluid and, in particular, to methods and apparatus used to provide strain relief for electrical cables in electronic faucets.

14 Claims, 20 Drawing Sheets

U.S. PATENT DOCUMENTS

| | | | | |
|---|---|---|---|---|
| 6,003,170 | A * | 12/1999 | Humpert et al. | 4/623 |
| 6,042,885 | A * | 3/2000 | Woollard et al. | 427/236 |
| 6,082,407 | A | 7/2000 | Paterson et al. | |
| 6,220,297 | B1 | 4/2001 | Marty et al. | |
| 6,273,394 | B1 | 8/2001 | Vincent | |
| 6,294,786 | B1 * | 9/2001 | Marcichow et al. | 250/341.1 |
| 6,363,549 | B2 | 4/2002 | Humpert | |
| 6,381,770 | B1 | 5/2002 | Raisch | |
| 6,588,453 | B2 | 7/2003 | Marty et al. | |
| 6,738,996 | B1 | 5/2004 | Malek et al. | |
| 6,757,921 | B2 | 7/2004 | Esche | |
| 6,845,526 | B2 | 1/2005 | Malek et al. | |
| 6,877,172 | B2 | 4/2005 | Malek et al. | |
| 6,962,168 | B2 | 11/2005 | McDaniel et al. | |
| 6,968,860 | B1 | 11/2005 | Haenlein et al. | |
| 2004/0088786 | A1 * | 5/2004 | Malek et al. | 4/677 |
| 2004/0135010 | A1 | 7/2004 | Malek et al. | |
| 2004/0144866 | A1 | 7/2004 | Nelson et al. | |
| 2005/0150556 | A1 * | 7/2005 | Jonte | 137/613 |
| 2005/0151101 | A1 | 7/2005 | McDaniel et al. | |

FOREIGN PATENT DOCUMENTS

| | | |
|---|---|---|
| WO | WO 91/17377 | 11/1991 |

OTHER PUBLICATIONS

Zurn® Plumbing Products Group, "AquaSense® Z6903 Series", Installation, Operation, Maintenance and Parts Manual, Aug. 2001, 5 pgs.

Zurn® Plumbing Products Group, "AquaSense® Sensor Faucet," Jun. 9, 2004, 2 pgs.

Sloan® Optima® i.q. Electronic Hand Washing Faucet, Apr. 2004, 2 pgs.

Symmons®, "Ultra-Sense® Battery-Powered, Sensor-Operated Lavatory Faucet S-6080 Series," Oct. 2002, 4 pgs.

Symmons® Commercial Faucets: Reliability With a Sense of Style, 1 pg.

Symmons®, "Ultra-Sense® Sensor Faucets with Position-Sensitive Detection," Aug. 2004, 4 pgs.

Symmons®, "Ultra-Sense® Sensor Faucet with Position-Sensitive Detection," © 2001-2002, 2 pgs.

Technical Concepts International, Inc., Capri AutoFaucet® with Surround Sensor™ Technology, 500556, 500576, 500577, (undated), 1 pg.

Technical Concepts, AutoFaucet® with "Surround Sensor" Technology, Oct. 2005, 4 pgs.

* cited by examiner

METHOD AND APPARATUS FOR PROVIDING STRAIN RELIEF OF A CABLE

CROSS-REFERENCE TO RELATED APPLICATIONS

This application claims the benefit of U.S. Provisional Application No. 60/662,107, filed Mar. 14, 2005, which is expressly incorporated by reference herein.

This application also expressly incorporates by reference the disclosure of each of the following applications: (1) U.S. patent application Ser. No. 10/755,581, filed Jan. 12, 2004, titled "MULTI-MODE HANDS FREE AUTOMATIC FAUCET," (2) U.S. patent application Ser. No. 10/755,582, filed Jan. 12, 2004, titled "CONTROL ARRANGEMENT FOR AN AUTOMATIC RESIDENTIAL FAUCET," (3) U.S. patent application Ser. No. 10,757,316, filed Jan. 14, 2004, now U.S. Pat. No. 6,962,168, titled "CAPACITIVE TOUCH ON/OFF CONTROL FOR AN AUTOMATIC RESIDENTIAL FAUCET," (4) U.S. patent application Ser. No. 10/912,254, filed Aug. 5, 2004, now U.S. Pat. No. 6,968,860, titled "RESTRICTED FLOW HANDS-FREE FAUCET," (5) U.S. Provisional Application No. 60/661,981, filed Mar. 14, 2005, titled "BATTERY BOX ASSEMBLY," (6) U.S. Provisional Patent Application Ser. No. 60/661,982, filed Mar. 14, 2005, titled "POSITION-SENSING DETECTOR ARRANGEMENT FOR CONTROLLING A FAUCET," and (7) U.S. Provisional Patent Application Ser. No. 60/662,106, filed Mar. 14, 2005, titled "VALVE BODY ASSEMBLY WITH ELECTRONIC SWITCHING" ("Related Applications"). It is understood that certain features disclosed and/or claimed in one or more of the Related Applications may be combined and/or claimed in combination with certain features disclosed in this application.

BACKGROUND AND SUMMARY OF THE INVENTION

This invention relates generally to a faucet and, more particularly, to an electronic faucet including a spout assembly having a sensor configured to control the flow of water therethrough. Further, this invention relates to methods and apparatus used to provide strain relief for electrical cables used in systems for providing fluid and in particular to methods and apparatus used to provide strain relief for electrical cables in faucets.

Faucets having pull-down or pull-out spray heads or wands are well-known. In these faucets, the pull-out spray heads are normally removably seated in the delivery spout. It is also known to provide a sensor assembly, often including an infrared sensor, within the delivery spout of the faucet. Such a sensor assembly is configured to detect the presence of a user's hands under the delivery spout and, in response thereto, cause an actuator driven valve to provide for a flow of water through the spout.

Strain relief for an electronic cable such as that within a faucet is configured to prevent unforeseen jerks on the cable from breaking wires or unplugging a connector associated with the electronic cable. Further, the random movement of an electronic cable within a faucet may have unintended consequences on sensors used in the faucet, in particular on capacitive sensors.

According to an illustrative embodiment of the present disclosure, an electronic faucet includes a delivery spout and a sensor assembly supported adjacent the outlet of the delivery spout. The sensor assembly includes a bracket which is operably coupled to the delivery spout. More particularly, the bracket provides mechanical support and electrical communication between the outer wall of the delivery spout and a printed circuit board. The sensor assembly further includes an infrared sensor and a sliding member having an embedded sensory element. A pull-out spray head is releasably coupled to the outlet of the delivery spout.

In one illustrative embodiment, a retainer is supported by the delivery spout and includes a plurality of arms having tabs which engage a groove formed within the spray head. The arms are resiliently biased radially inwardly to engage the groove. A collar or hose nut is operably coupled to the spray head and is configured to engage the sliding member. More particularly, when the spray head is coupled to the outlet of the delivery spout, the sliding member is moved upwardly by the collar. Similarly, when the spray head is detached from the delivery spout, the sliding member moves downwardly. The magnet embedded within the sliding member cooperates with a Hall effect sensor mounted on the circuit board, illustratively to automatically activate the supply of water to the spray head upon removal of the spray head from the delivery spout. The spray head illustratively includes a plurality of tabs or ribs which are configured to rotationally engage the plurality of arms of the retainer. Cooperation between the ribs of the spray head and the arms of the retainer permit changes in water flow between an aerated stream and a spray upon rotation of a portion of the spray head.

In another illustrative embodiment, an electronic faucet is provided. The electronic faucet includes a delivery spout having an outlet, a pull-out spray head removably coupled to the outlet of the delivery spout for movement between a coupled position and an uncoupled position, and a sensor configured to detect the position of the spray head relative to the outlet of the delivery spout. A controller is operably coupled to the sensor and is configured to control water flow in response to the detected position of the sensor.

In a further illustrative embodiment, a faucet is provided including a pull-down spout. The faucet is configured such that pulling out the pull-down spout activates water flow.

In a further illustrative embodiment, an electronic faucet is provided. The electronic faucet includes a delivery spout having an outlet, a pull-out spray head having a plurality of ribs, and a retainer removably coupling the spray head to the outlet of the delivery spout. The retainer includes a plurality of retaining members configured to rotationally engage the plurality of ribs of the spray head for controlling water flow therethrough.

In still another illustrative embodiment, an electronic faucet assembly is provided. The electronic faucet assembly includes a spout assembly having an electronic sensor positioned proximate an upper portion of the spout assembly and an electrical cable running through an interior of the spout assembly from a lower portion to the upper portion. The electrical cable is operably coupled to the electronic sensor. A cable holder is positioned proximate to the lower portion of the spout assembly and is coupled to the spout assembly. The cable holder is configured to hold a first portion of the electrical cable to provide strain relief against an external force on a second portion of the electrical cable more distal from the spout assembly than the first portion and to generally compress the electrical cable within the interior of the spout assembly to minimize unintended movement of the electrical cable within the interior of the spout assembly.

In yet a further illustrative embodiment, a cable holder for retaining an electrical cable relative to a housing is provided. The cable holder includes a lower portion configured to be coupled to the housing, and an upper portion for engaging a portion of the electrical cable. The upper portion includes a plurality of legs which cooperate to provide the portion of the electrical cable with a serpentine path.

In still yet a further illustrative embodiment, an electronic faucet assembly is provided. The electronic faucet assembly includes a delivery spout, and a valve body spaced apart from the delivery spout. A spout control cable extends upwardly through the delivery spout. A spout strain relief member is positioned proximate to a base of the delivery spout and is operably coupled to the spout control cable. A valve control cable extends upwardly into the valve body. A valve strain relief member is operably coupled to the valve control cable.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
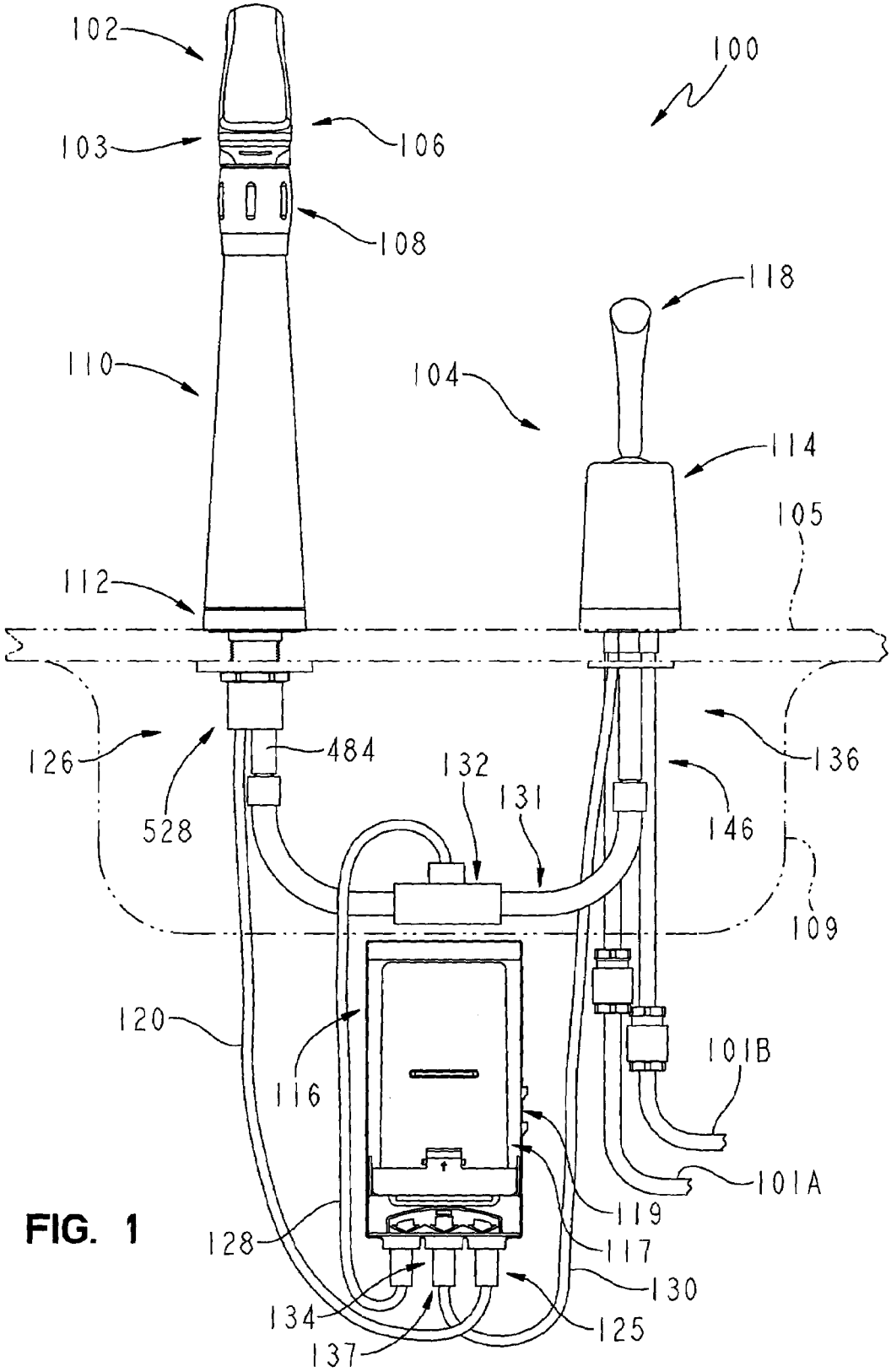
FIG. 1 is a front plan view of an illustrative embodiment electronic faucet system including a valve body assembly having an electrical cable extending therefrom to a controller assembly, and a spout assembly having an electrical cable extending therefrom to the controller assembly.
Figure 2:
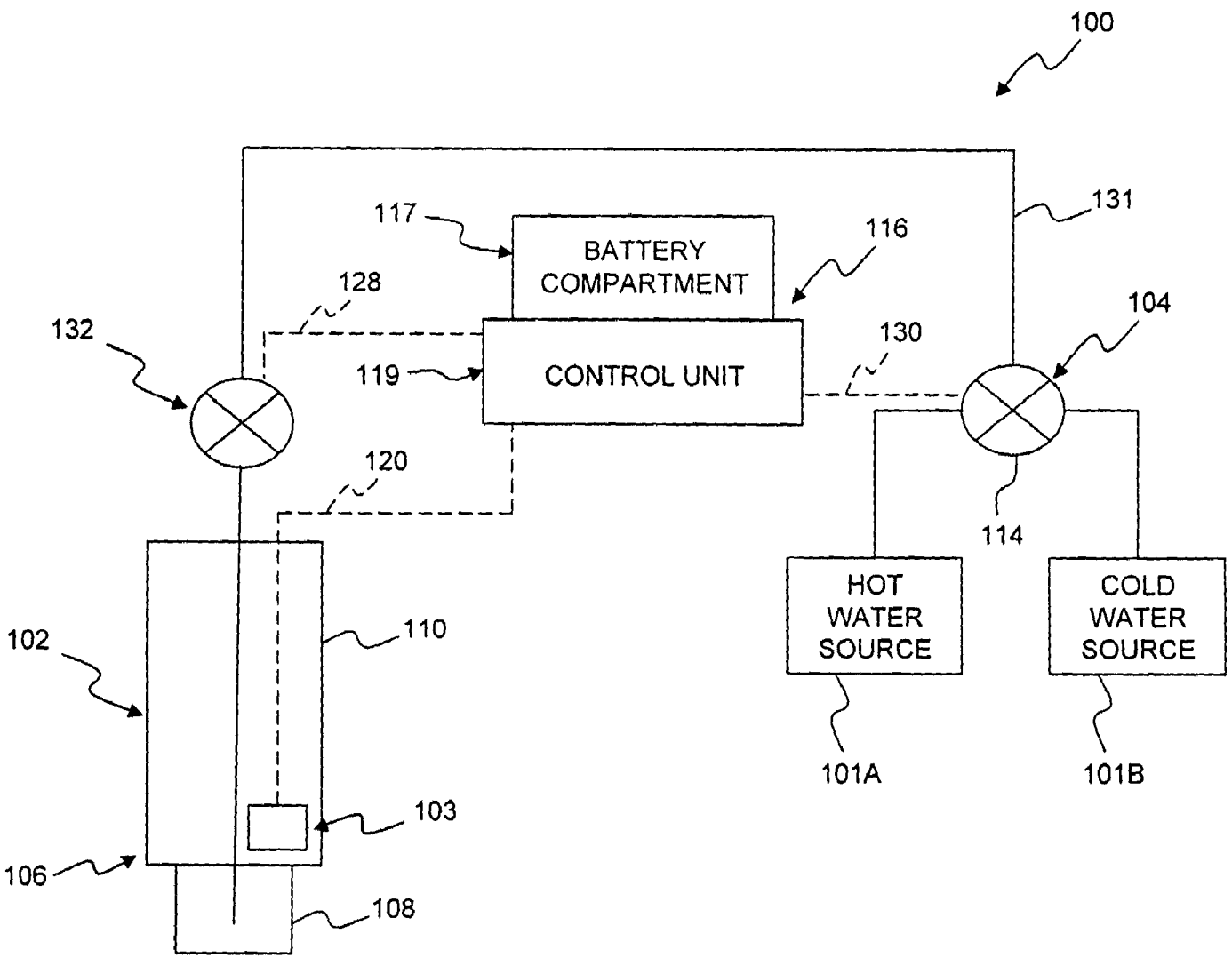
FIG. 2 is a block diagram illustrating the electronic faucet system of FIG. 1.
Figure 22:
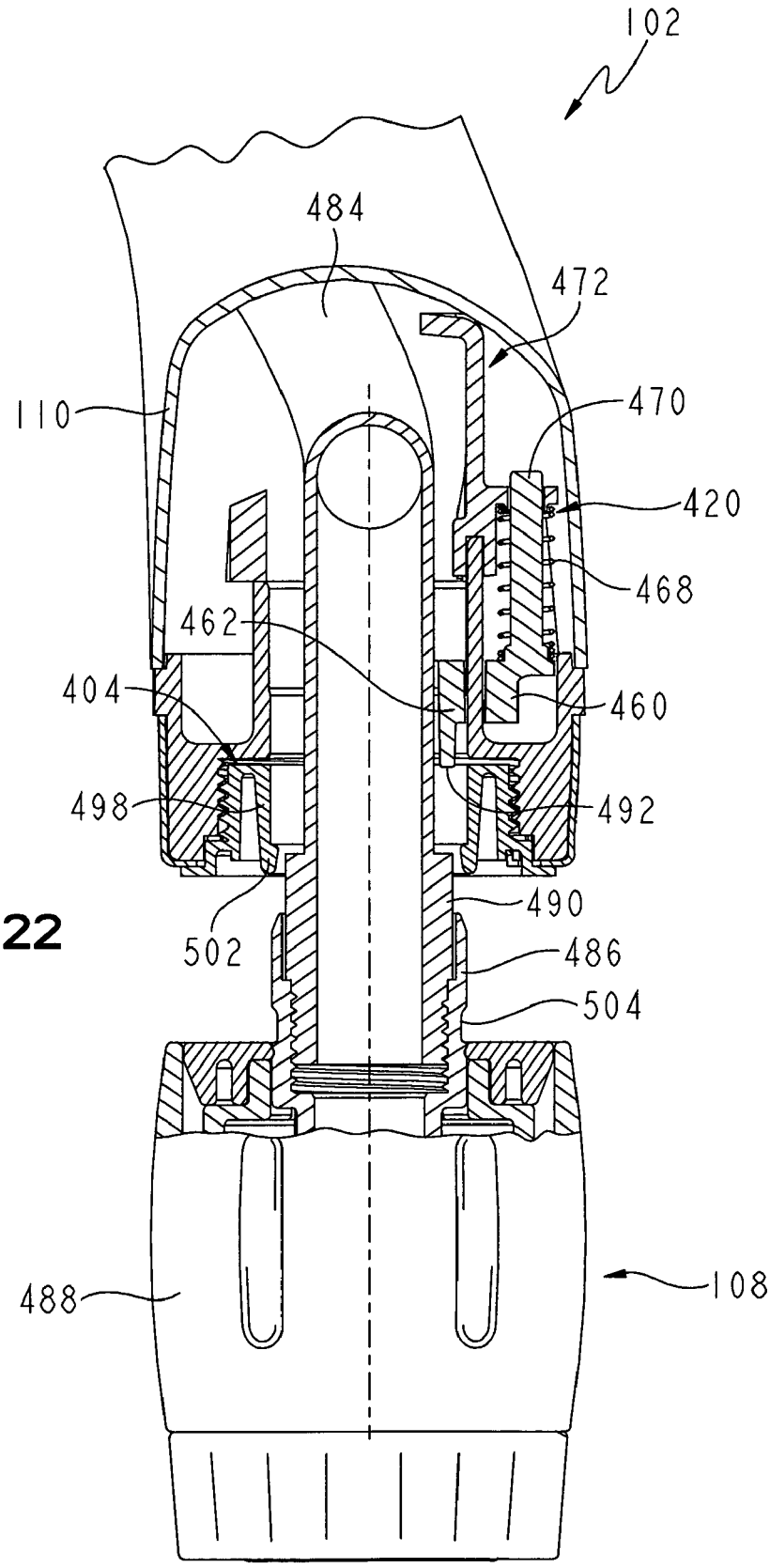
FIG. 22 is a cross-sectional view similar to FIG. 21, showing the spray head uncoupled from the delivery spout.

Referring initially to FIGS. 1 and 2, an illustrative electronic faucet system 100 is shown fluidly coupled to a hot water source 101A and a cold water source 101B. Faucet system 100 includes a spout assembly 102 and a valve body assembly 104 mounted to a sink deck 105. As explained in more detail herein and in one or more of the Related Applications, including U.S. Provisional Patent Application Ser. No. 60/661,982, filed Mar. 14, 2005, titled "POSITION-SENSING DETECTOR ARRANGEMENT FOR CONTROLLING A FAUCET," the disclosure of which has been previously expressly incorporated by reference herein, spout assembly 102 illustratively includes several electronic sensors. More particularly, spout assembly 102 illustratively includes a sensor assembly 103 having an infrared sensor generally in an upper portion 106 of spout assembly 102 to detect the presence of an object, such as a user's hands. Sensor assembly 103 further illustratively includes a Hall effect sensor positioned in upper portion 106 to detect when a pull-out or pull-down spray head 108 is spaced apart from upper portion 106 (as shown in FIG. 22), for example when a user is directing water flow to desired objects within a sink basin 109. Sensor assembly 103 additionally illustratively includes a capacitance touch sensor wherein fluid flow from spout assembly 102 may be activated by the user touching spout assembly 102. Additional sensors or electronic devices may be positioned within or attached to spout assembly 102.

Due to the presence of electronics (such as the described sensors) generally within upper portion 106, a spout control electrical cable 120 is contained within a delivery spout 110 of spout assembly 102 and provides electrical communication between sensor assembly 103 and a controller 116. Illustratively, controller 116 includes a battery compartment 117 operably coupled to a control unit 119. Additional details of the controller 116 are provided in one or more of the Related Applications, including U.S. Provisional Patent Application Ser. No. 60/661,981, filed Mar. 14, 2005, titled "BATTERY BOX ASSEMBLY," the disclosure of which has been previously expressly incorporated by reference herein.

Valve body assembly 104 also illustratively includes several sensors as explained in more detail in one or more of the Related Applications including U.S. Provisional Patent Application Ser. No. 60/662,106, filed Mar. 14, 2005, titled "VALVE BODY ASSEMBLY WITH ELECTRONIC SWITCHING," the disclosure of which has been previously expressly incorporated by reference herein. Valve body assembly 104 illustratively includes a conventional manual valve member (such as a mixing ball or disc) to provide for the manual control of the flow and temperature of water in response to manual manipulation of a handle 118 supported for movement relative to a holder 114. A Hall effect sensor (not shown) is illustratively positioned in holder 114 to detect a position of the manual valve member, and hence, the handle 118. Valve body assembly 104 further illustratively includes a capacitance touch sensor (not shown) wherein fluid flow from spout assembly 102 may be activated by the user touching valve body assembly 104. Additional sensors or electronic devices may be positioned within or attached to valve body assembly 104. Due to the presence of electronics (such as the described sensors) generally within holder 114, a valve control electrical cable 130 is contained within holder 114 and provides electrical communication with controller 116.

With further reference to FIG. 2, the faucet system 100 is in fluid communication with hot water source 101A and cold water source 101B. The valve body assembly 104 illustratively mixes hot water from the hot water source 101 and cold water from the cold water source 101 to supply a mixed water to an actuator driven valve 132 through a mixed water conduit 131. Illustratively, the actuator driven valve 132 comprises a conventional magnetically latching solenoid valve of the type available from R.P.E. of Italy. The actuator driven valve 132 is controlled by the controller 116 through an electrical cable 128 and, as such, controls the flow of mixed water supplied to the spout assembly 102. As shown in FIGS. 1 and 2, the valves 104 and 132 are arranged in series and are fluidly coupled by mixed water conduit 131. The spout assembly 102 is configured to dispense mixed water through spray head 108 and into conventional sink basin 109.

As shown in FIGS. 1 and 2, when the actuator driven valve 132 is open, the faucet system 100 may be operated in a conventional manner, i.e., in a manual control mode through operation of the handle 118 and the manual valve member of valve body assembly 104. Conversely, when the manually controlled valve body assembly 104 is set to select a water temperature and flow rate, the actuator driven valve 132 can be touch controlled, or activated by proximity sensors when an object (such as a user's hands) are within a detection zone to toggle water flow on and off.

In an illustrative embodiment, the actuator driven valve 132 is controlled by electronic circuitry within control unit 119 that implements logical control of the faucet assembly 100. This logical control includes at least two functional modes: a manual mode, wherein the actuator driven valve 132 remains open, and a hands-free mode, wherein the actuator driven valve 132 is toggled in response to signals from a proximity sensor. Thus, in the manual mode, the faucet assembly 100 is controlled by the position of the handle 118 in a manner similar to a conventional faucet, while in the hands-free mode, the flow is toggled on and off in response to the proximity sensor (while the flow temperature and rate are still controlled by the handle 118 position).

Illustratively, the faucet assembly 100 is set to operate in a hands-free mode by user interaction, for example by input from a push-button, by input from a strain gauge or a piezoelectric sensor incorporated into a portion of the faucet assembly 100, such as the spout assembly 102, or by input from a capacitive touch button or other capacitive touch detector. It will be appreciated that a touch control, whether implemented with a strain gauge or a capacitive touch-sensor can respond to contact between a user and the handle 118 that is insufficient to change a position of the handle 118.

The capacitive touch control may be incorporated into the spout assembly 102 of the faucet assembly 100, as taught by U.S. Pat. No. 6,962,168, titled "CAPACITIVE TOUCH ON/OFF CONTROL FOR AN AUTOMATIC RESIDENTIAL FAUCET," the disclosure of which has been previously expressly incorporated by reference herein. In certain illustrative embodiments, the same mode-selector can be used to return the faucet assembly 100 from hands-free mode to manual mode. In certain of these illustrative embodiments, as detailed herein, a touch-sensor is also incorporated into the handle 118. In such illustrative embodiments, the two touch controls can either operate independently (i.e. mode can be changed by touching either one of the touch controls), or together, so that the mode is changed only when both touch controls are simultaneously touched.

In certain alternative embodiments, once placed in hands-free mode the faucet assembly 100 can be returned to manual mode simply by returning the manual faucet control handle 118 to a closed position. In addition, in certain illustrative embodiments the faucet assembly 100 returns to manual mode after some period of time, such as 20 minutes, without user intervention. This time-out feature may be useful for applications in which power is supplied by batteries, because it preserves battery life. In one illustrative embodiment, once the hands-free mode is activated, the actuator driven valve 132 is closed, stopping the water flow. This state is the hands-free standby state, in which water flow will be activated by a proximity detector. The manual valve handle 118 preferably remains in the open position. In other words, the manual valve body assembly 104 remains open, so that flow is halted only by the actuator driven valve 132.

In the hands-free standby state, objects positioned within the sensor's trigger zone cause the faucet assembly 100 to enter the hands-free active state, wherein the actuator driven valve 132 is opened, thus permitting the water to flow. The faucet assembly 100 remains in hands-free active mode, and the actuator driven valve 132 remains open, as long as objects are detected within the sensor's trigger zone. When objects are no longer detected in the sensor's trigger zone, the faucet assembly 100 returns to hands-free standby mode, and the actuator driven valve 132 closes.

It will be appreciated that water flow is important while a user is attempting to adjust the flow rate or temperature. More particularly, the user observes these properties as they are adjusted, in effect completing a feedback loop. Thus, adjustment of the flow properties is another case in which water flow is preferably activated without requiring the user to place his or her hands or an object in the trigger zone. Therefore, in the illustrative embodiment, when the faucet assembly 100 is in standby hands-free mode, the faucet assembly 100 switches to active hands-free mode, and the actuator driven valve 132 is opened, whenever the manual control handle 118 is touched.

In certain alternative embodiments, when the handle 118 is touched while in hands-free mode, the faucet assembly 100 switches to manual mode, which will, of course, also result in activating the water flow (unless the handle is closed), as well as the deactivation of the proximity sensor. If the user wishes to then return to hands-free mode, he or she may reactivate it in the usual way, such as by a touch control.

In the illustrative embodiment, the faucet assembly 100 does not immediately enter the hands-free mode when the manual valve body assembly 104 is opened and released. Instead, the faucet assembly 100 enters a "quasi-hands-free" state, in which the faucet assembly 100 continues to be manually controlled, and the actuator driven valve 132 remains open. This quasi-hands-free state persists as long as the proximity sensor does not detect the presence of an object within the sensor's trigger zone. This allows the faucet assembly 100 to function as a normal manual valve when initially operated, but to switch modes to hands-free automatically when sensing the presence of an object within the trigger zone. The advantage of this quasi-hands-free mode is that the faucet assembly 100 can be operated as a conventional manual faucet without the necessity of manually selecting the manual mode. This is valuable, for example, in single-use activations such as getting a glass of water or when guests use the faucet assembly 100. In these embodiments, when the user initially opens the faucet assembly 100 and adjusts the water temperature or flow rate and then releases the handle 118, the water does not immediately shut off, thereby frustrating the user's attempt to operate the faucet assembly 100 as a manual faucet. After the user has adjusted the flow, and places an object within the faucet assembly's detection zone, the faucet assembly 100 will then enter hands-free mode.

Because the behavior of the faucet assembly 100 in response to its various input devices is a function of the mode it is presently in, illustratively, the faucet assembly 100 includes some type of low-power indicator to identify it's current mode. Appropriate indicators include LEDs (light emitting diodes), LCDs (liquid crystal displays), or a magnetically latching mechanical indicator. In certain embodiments, the mode indicator may simply be a single bit indicator (such as a single LED) that is activated when the faucet assembly 100 is in hands-free mode. Alternatively, the mode indicator may include a separate bit display for each possible mode. In still other embodiments, the mode indicator may indicate mode in some other way, such as a multi-color LED, in which one color indicates hands-free mode, and one or more other colors indicate other modes. Additional details regarding the mode indicator are provide herein. Further, transition between modes may illustratively be indicated by an audio output.

When a user is finished using the faucet assembly 100, the faucet assembly 100 is illustratively powered down and returned to a baseline state. Powering down provides power savings, which makes it more feasible to operate the faucet assembly 100 from battery power. Returning the faucet assembly 100 to a baseline state is helpful because it gives predictable behavior when the user first begins using the faucet assembly 100 in a particular period of operation. Preferably, the baseline state is the manual mode, since the next user of the faucet assembly 100 might not be familiar with the hands-free operation. Illustratively, a user is able to power down the faucet assembly 100 and return it to the manual, baseline mode simply by returning the manual handle 118 to the closed position, because this is a reflexive and intuitive action for users.

As a consequence, the illustrative embodiment faucet assembly 100 is configured to sense whether the handle 118 is in the closed position. It will be appreciated that this can be accomplished directly, via a sensor in the valve body assembly 104 that detects when the manual valve member is closed, such as by including a small magnet in the handle 118, and an appropriately positioned Hall effect sensor. Alternatively, the handle position can be observed indirectly, for example by measuring water pressure above and below the manual valve, or with a commercial flow sensor. However, it will be appreciated that this inference (that the handle 118 is in a closed position) is only valid if the electrically operable valve is open. It will be appreciated that, because the actuator driven valve 132 is controlled electronically, this is easily tracked by the controller 116. Thus, in the illustrative embodiment, the faucet assembly 100 is returned to manual mode when both the actuator driven valve 132 is open and water is not flowing through the faucet assembly 100.

Illustratively, the faucet assembly 100 also includes a "watchdog" timer, which automatically closes the actuator driven valve 132 after a certain period of time, in order to prevent overflowing or flooding. In certain of these illustrative embodiments, normal operation is resumed once an object is no longer detected in the sensor's trigger zone. In certain other illustrative embodiments, normal operation is resumed once the manual valve body assembly 104 is closed. In still other illustrative embodiments, normal operation is resumed in either event. In those illustrative embodiments including a hands-free mode indicator, the indicator is flashed, or otherwise controlled to indicate the time-out condition.

In addition to the various power-saving measures described above, the illustrative embodiment also includes an output mechanism that alerts users when batter power is low. It will be appreciated that any suitable output mechanism may be used, but illustratively an LED and an audio output are used.

With reference to FIGS. 1 and 3-6, electrical cable 120 includes a first end 122 having a connector 123 which is electrically coupled to a circuit board 127 (FIG. 4) in upper portion 106 of spout assembly 102, and a second end 124 having a connector 125 which is electrically coupled to the controller 116.

Figure 4:
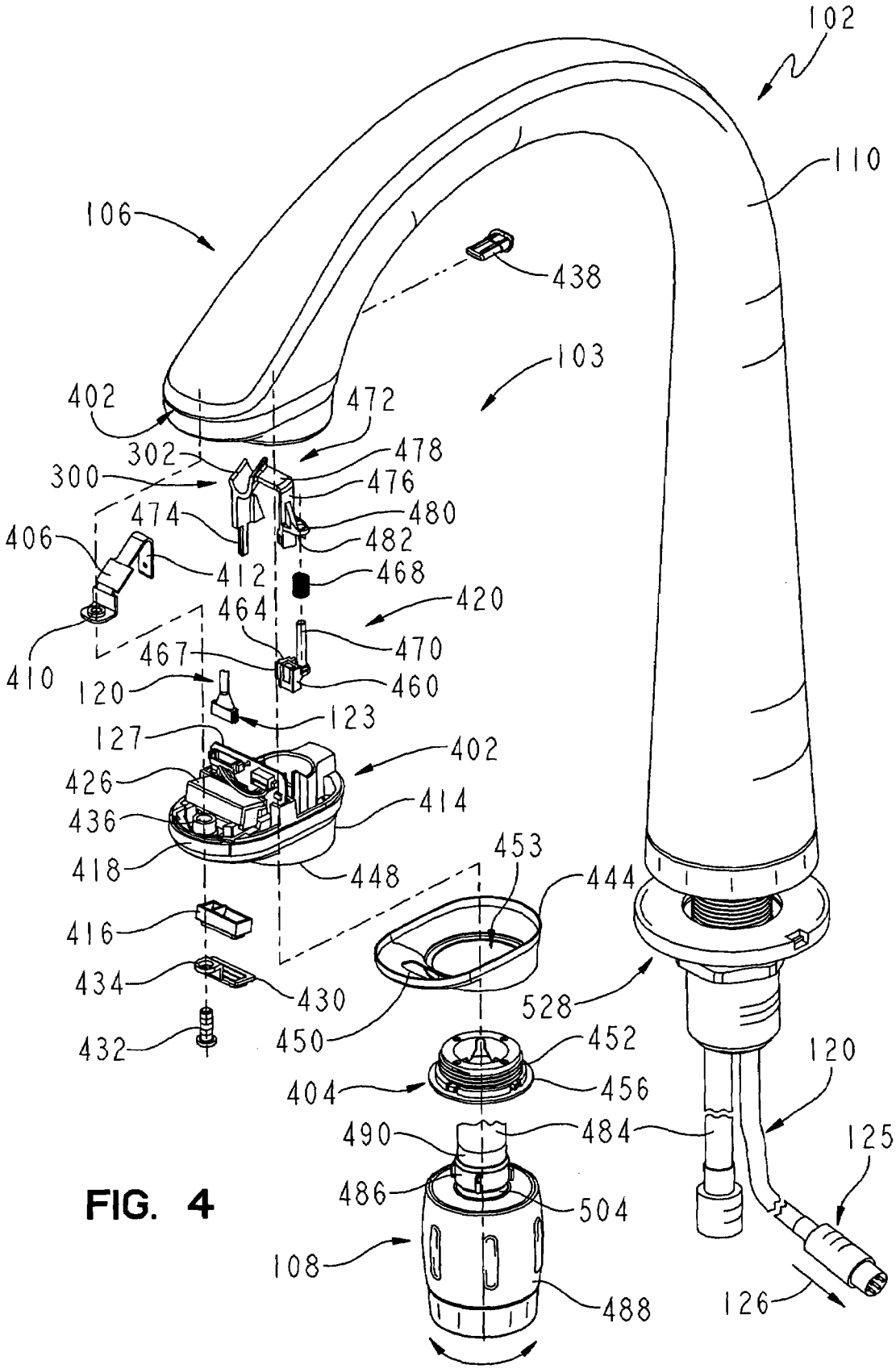
FIG. 4 is a perspective view similar to FIG. 3, with a partial cut-away thereof, showing the sensor assembly and the spray head coupling exploded from the spout.

Controller 116 and hence at least a portion of electrical cable 120 is positioned underneath the sink deck 105 to which spout assembly 102 and valve body assembly 104 are attached. Electrical cable 120 may be subject to unexpected jerks or other external forces under the sink deck 105 that may place an axial force generally in direction 126 on electrical cable 120 (FIG. 4). Such axial force 126 may cause the movement of electrical cable 120 within delivery spout 110, such as within upper portion 106, and may break a wire in electrical cable 120 or connector 123, and/or unplug connector 123 from circuit board 127. Movement of electrical cable 120 may influence the operation of the capacitance touch sensor in spout assembly 102 because such movement may be interpreted by the capacitance touch sensor as a "false touch event" (i.e., the sensor erroneously thinks a user has touched delivery spout 110). Also, a movement of electrical cable 120 may prevent a "real touch event" (a user actually touching the sensor tube) from activating fluid flow from spout assembly 102.

Figure 7:
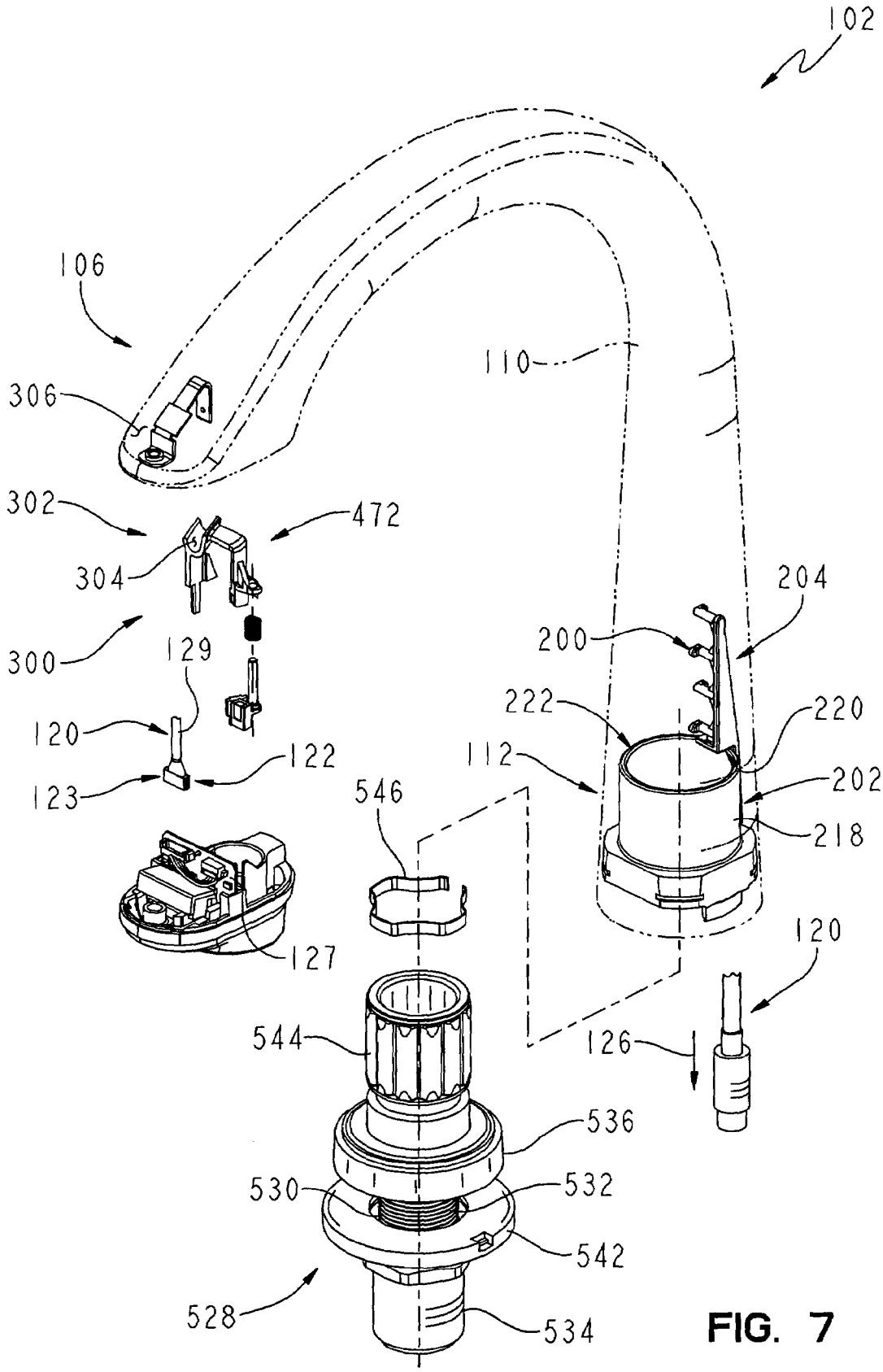
FIG. 7 is a partial perspective view of the spout assembly of FIG. 1, with a partial cut-away thereof, showing various components of the spout assembly exploded therefrom including a first electrical cable holder and a second electrical cable holder.
Figure 8:
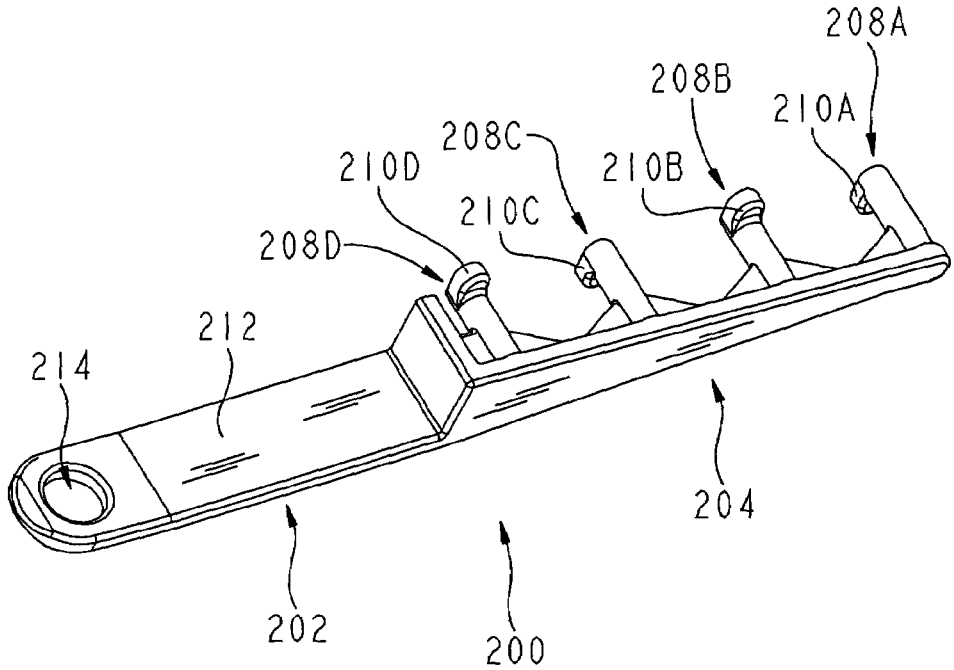
FIG. 8 is a perspective view the first electrical holder of FIG. 7.
Figure 9:
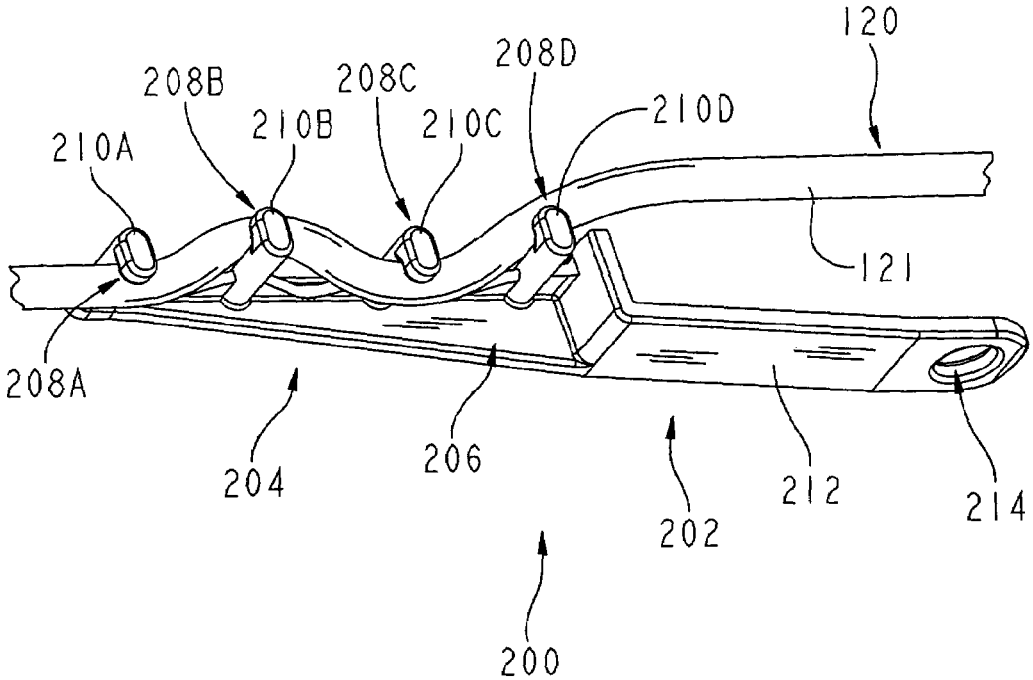
FIG. 9 is a perspective view of the first electrical holder of FIG. 7, with the electrical cable of FIG. 6 assembled thereto.

With reference to FIGS. 7-9, in order to prevent or minimize the movement of electrical cable 120 within delivery spout 110 and/or to prevent or minimize the strain exerted on electrical cable 120 within delivery spout 110 due to axial forces in direction 126, a spout first strain relief member or electrical cable holder 200 is provided proximate to a lower portion 112 of spout assembly 102 and a spout second strain relief member or electrical cable holder 300 is provided proximate to upper portion 106 of spout assembly 102. By preventing or minimizing the strain exerted on electrical cable 120 within delivery spout 110 due to axial forces in direction 126, first electrical holder 200 provides strain relief to the electrical cable 120 of spout assembly 102.

Referring further to FIG. 7, a partially exploded view of an illustrative embodiment of spout assembly 102 is shown. Additional details about the operation of spout assembly 102 are provided herein and in one or more of the Related Applications including U.S. Provisional Patent Application Ser. No. 60/661,982, filed Mar. 14, 2005, titled "POSITION- SENSING DETECTOR ARRANGEMENT FOR CONTROLLING A FAUCET," the disclosure of which has been previously expressly incorporated by reference herein.

With reference to FIGS. 6-10, first spout electrical holder 200 supports a middle portion 121 of electrical cable 120, which is positioned generally proximate to a lower portion 112 of spout assembly 102. First spout electrical holder 200 includes a lower portion 202 and an upper portion 204. Lower portion 202 couples first electrical holder 200 to spout assembly 102 and upper portion 204 holds or retains electrical cable 120.

As shown in FIGS. 8 and 9, upper portion 204 includes a base member 206 and a plurality of extending protrusions or legs 208, illustratively shown as three legs 208A, 208B, 208C, and 208D. In alternative embodiments, the number and relative positioning of legs 208 may vary. Legs 208A-D are shown as being spaced apart and generally linearly arranged. In alternative embodiments, the legs may be spaced apart and arranged in a non-linear fashion. Each of legs 208A-D include a foot or tab 210A-D, respectively. Tabs 210A-D limit the movement of electrical cable 120 along a longitudinal extent of legs 208A-D. Tabs 210A-D project outward to a side of the respective leg 208A-D that electrical cable 120 is contacting as shown in FIG. 9. In FIG. 9, tabs 210A-D are arranged in an alternating fashion due to the placement of electrical cable 120.

In alternative embodiments other types of holders may be used for first electrical holder 200, such as a clip similar to clip 152 which interacts with a sleeve, such as sleeve 160, or other suitable means for preventing or minimizing the movement of electrical cable 120, such as clamps.

Figure 10:
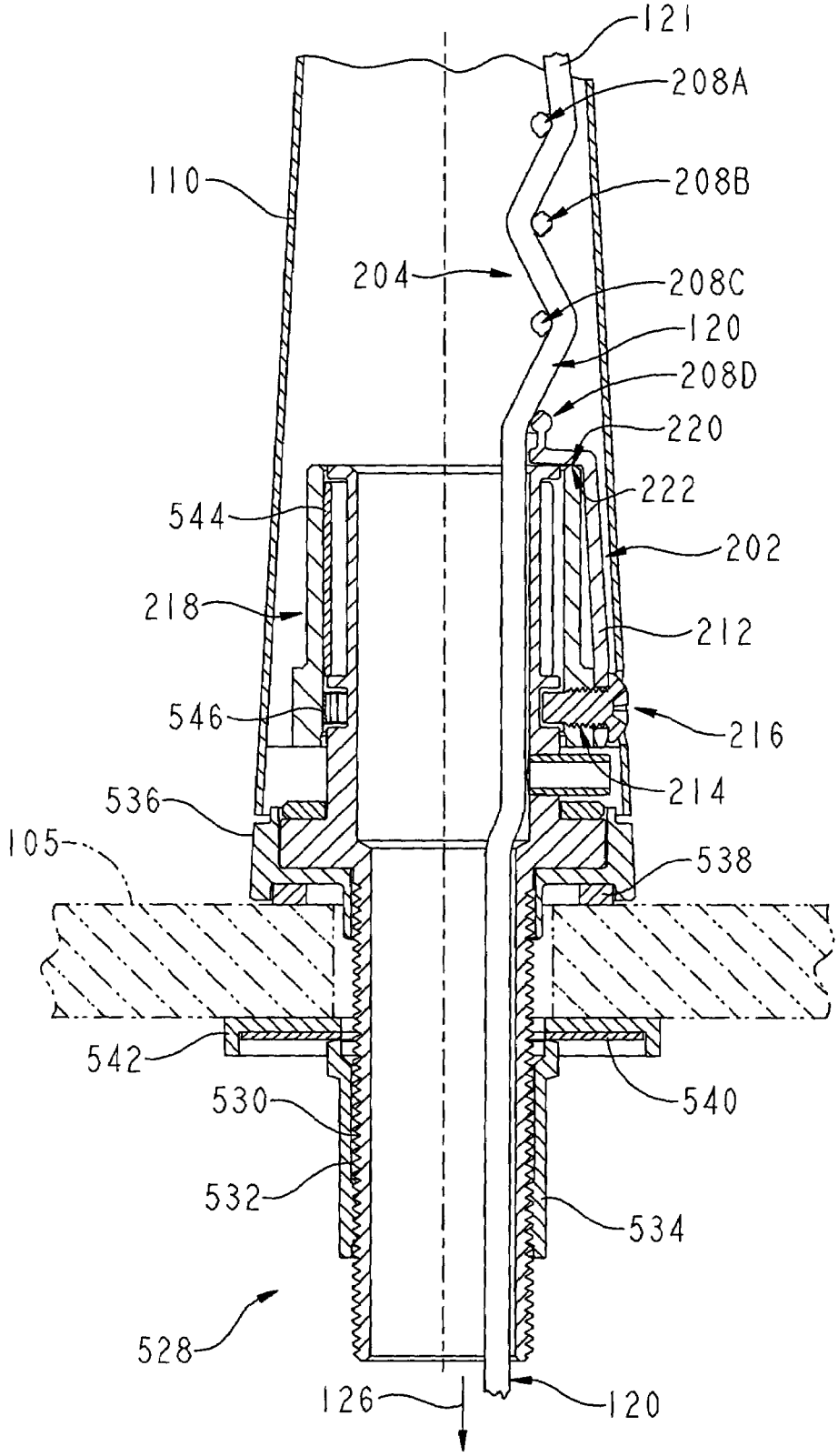
FIG. 10 is a sectional view of a lower portion of the spout assembly of FIG. 1, with the fluid conduit removed for clarity, illustrating the placement of the first electrical holder and the electrical cable of FIG. 9.

Lower portion 202 includes a finger 212 which includes an opening 214. Referring to FIG. 10, opening 214 is sized to receive a fastener 216 which is threadably received in a spout hub 218 of spout assembly 102. Finger 212 is offset relative to legs 208A-D by a ledge 220 which rests upon an upper portion 222 of spout hub 218.

Referring further to FIG. 9, middle portion 121 of the electrical cable 120 when assembled to first electrical holder 200 includes multiple bends. In the illustrative embodiment, electrical cable 120 is passed through legs 208A-D such that electrical cable 120 has a generally serpentine path. This bending of electrical cable 120 about legs 208A-D, the rigidity of the first electrical holder 200, and the stiffness of cable 120 prevents or minimizes the movement of electrical cable 120 relative to first electrical holder 200 when an axial force is applied in direction 126. As such, by placing first electrical holder 200 proximate to the lower portion 112 of spout assembly 102, the movement of electrical cable 120 within delivery spout 110 due to the application of an external force in direction 126 is reduced, and illustratively minimized.

By placing first electrical holder 200 on a proper position of electrical cable 120, unintended movement of electrical cable 120 within spout housing 110 may be reduced or prevented. In one embodiment, the portion of electrical cable 120 held by first electrical holder 200 is selected such that an additional portion of electrical cable is contained within spout housing 110 and follows an inner surface thereof. It is characterized as an additional portion because it is a longer section of electrical cable than is needed to span the distance from upper portion 106 to lower portion 112. Due to the stiffness of the electrical cable 120 when an appropriate additional portion of electrical cable is selected, the electrical cable 120 within spout housing 110 will be at least partially compressed thereby minimizing the movement of the electrical cable within spout housing 110. In another embodiment, the portion of electrical cable 120 held by first electrical holder 200 is selected such that electrical cable 120 is held firmly between first electrical holder 200 and second electrical holder 300 thereby minimizing the movement of the electrical cable 120.

Figure 6:
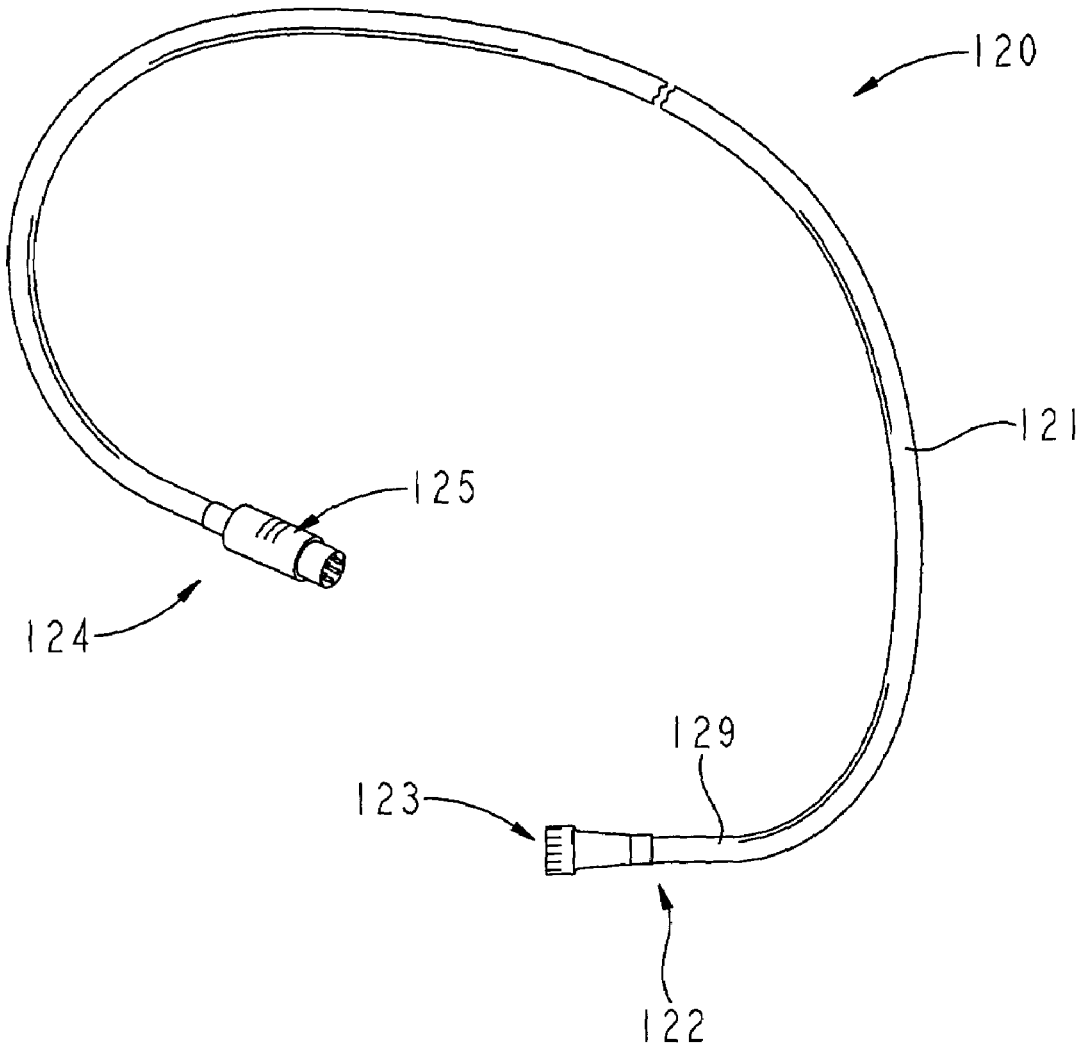
FIG. 6 is a perspective view of an electrical cable of the spout assembly of FIG. 1 including a first end and a second end.

With reference to FIGS. 6 and 7, spout second electrical holder 300 supports electrical cable 120 generally proximate to first end 122 which includes connector 123 for connection to circuit board 127. Spout second electrical holder 300 is illustratively defined by support bracket 472 as detailed herein, and illustratively includes a cradle 302. Cradle 302 includes a surface 304, illustratively shown as being generally cylindrical, which generally mates with an exterior surface 129 of electrical cable 120. When spout assembly 102 is assembled, electrical cable 120 is held in place due to a contact between surface 129 of electrical cable 120 and surface 304 of cradle 302, and due to a contact between surface 129 and an inner surface 306 of delivery spout 110.

In alternative embodiments other types of holders may be used for second electrical holder 300, such as a clip similar to clip 152 which interacts with a sleeve, such as sleeve 160, or other suitable means for preventing or minimizing the movement of electrical cable 120, such as clamps.

Figure 11:
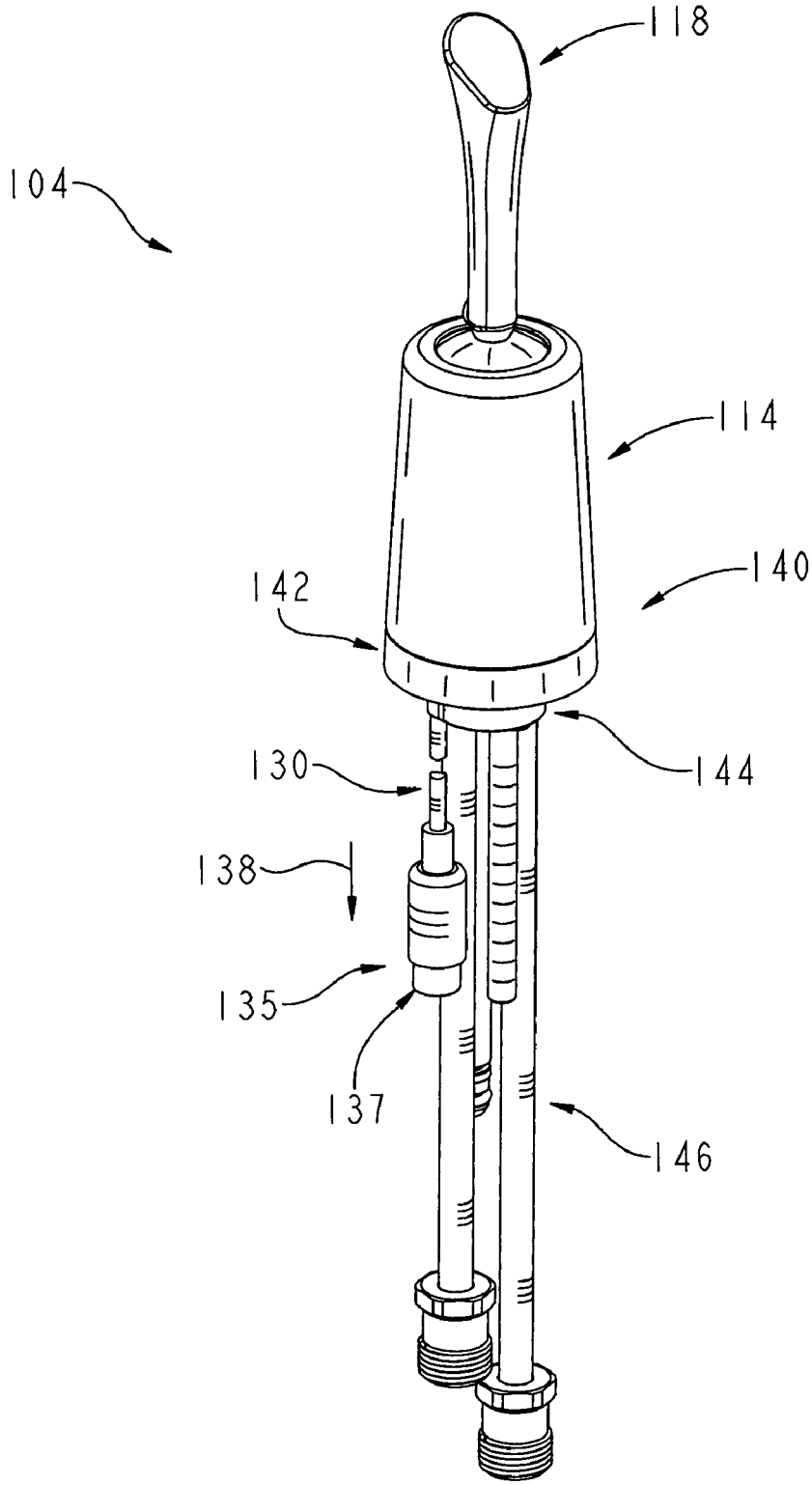
FIG. 11 is a perspective view of the valve body assembly of FIG. 1.
Figure 13:
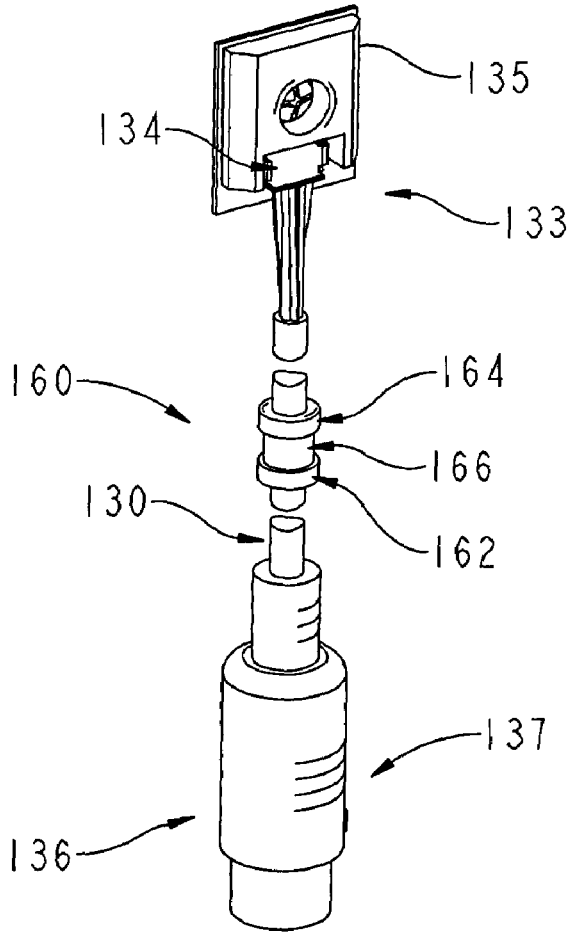
FIG. 13 is a perspective view, with partial cutaways thereof, of the electrical cable of the valve body assembly of FIG. 11, the electrical cable including a sleeve attached thereto.

Referring now to FIGS. 1, 11, and 13, electrical cable 130 of valve body assembly 104 includes a first end 133 having a connector 134 which is electrically coupled to a circuit board 135 in valve body assembly 104 (FIG. 13) and a second end 136 having a connector 137 which is electrically coupled to controller 116. As stated before, controller 116 and hence at least a portion of electrical cable 130 are positioned underneath the sink deck 105 to which spout assembly 102 and valve body assembly 104 are attached. Electrical cable 130 may be subject to unexpected jerks or other external forces under the sink deck 105 that may place an axial force generally in direction 138 on electrical cable 130 (FIG. 11). Such axial force 138 may cause the movement of electrical cable 130 within holder 114, may break a wire in electrical cable 130 or its associated connectors 134 and 137, and/or unplug connectors 134 and 137. The movement of electrical cable 130 within holder 114 may influence the operation of the capacitance touch sensor in valve body assembly 104 because such movement may cause a false touch event or frustrate a real touch event.

In order to prevent or minimize the movement of electrical cable 130 within holder 114 and/or to prevent or minimize the strain exerted on electrical cable 130 within holder 114 due to axial forces in direction 138, valve strain relief member or valve electrical cable holder 400 (FIGS. 12, 14 and 15) is provided. By preventing or minimizing the strain exerted on electrical cable 130 within holder 114 due to axial forces in direction 138, valve electrical cable holder 400 provides strain relief to the electrical cable 130 of valve body assembly 104.

Figure 12:
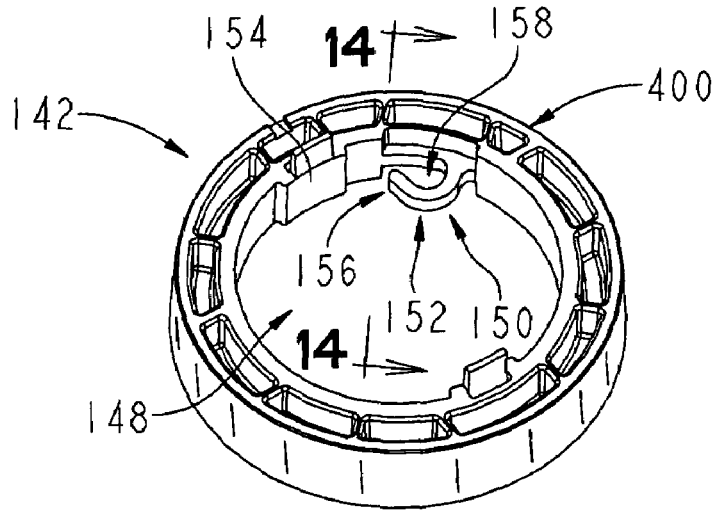
FIG. 12 is a perspective view of a base member of the valve body assembly of FIG. 11, the base member including a retainer member.

Referring to FIG. 11, valve body assembly 104 is shown. A lower portion 140 of valve body assembly 104 includes a base member 142, a gasket 144, and associated plumbing or water conduits 146. Referring to FIG. 12, base member 142 includes a central opening 148 for receiving conduits 146 and electrical cable 130. Base member 142 further includes a retainer 150, which defines the valve electrical cable holder 400 by holding or otherwise restraining the movement of electrical cable 130. Retainer 150 is illustratively shown as an arcuate clip 152 extending from an inner wall 154 of base member 142. In one illustrative embodiment, clip 152 is made of a resilient material such that an end portion 156 may be further spaced apart from inner wall 154 to receive electrical cable 130 and thereafter at least partially return towards inner wall 154 to retain electrical cable 130.

In the illustrated embodiment shown in FIGS. 14 and 15, clip 152 clips over electrical cable 130 directly below a first end portion 162 of a sleeve 160 which is coupled to electrical cable 130. In one embodiment, sleeve 160 is a molded component coupled to electrical cable 130. In alternative embodiments, the sleeve 160 may be integrally formed with the electrical cable 130. First end portion 162 of sleeve 160 has a radial extent large enough to prevent the passage of sleeve 160 into an opening 158 of clip 152. As such, sleeve 160 prevents the axial movement of electrical cable 130 is direction 138 due to the interaction between first end portion 162 of sleeve 160 and clip 152.

Figure 14:
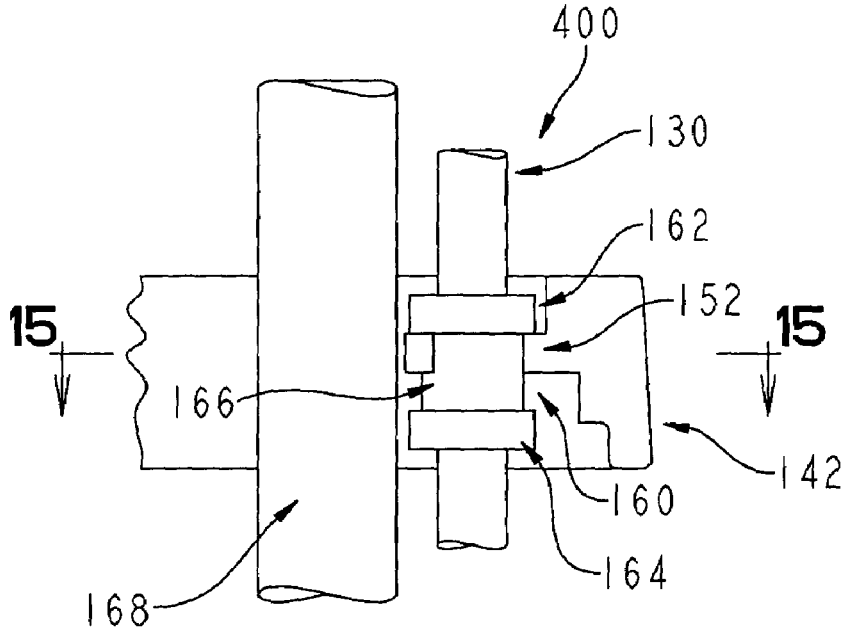
FIG. 14 is a view, taken along line 14-14 of FIG. 12, showing the interaction between the retainer member of the valve body assembly of FIG. 12 and the sleeve of the electrical cable of FIG. 13 when the two are assembled together.

Referring further to FIG. 14, sleeve 160 illustratively further includes a second end portion 164, and a reduced diameter intermediate portion 166 located between first end portion 162 and second end portion 164. In one embodiment, clip 152 receives reduced diameter intermediate portion 166 of sleeve 160 such that any axial movement of electrical cable 130 is limited by the contact of clip 152 with one of first end portion 162 or second end portion 164. As such, sleeve 160 may prevent the movement of electrical cable 130 in both axial directions relative to clip 152.

Figure 15:
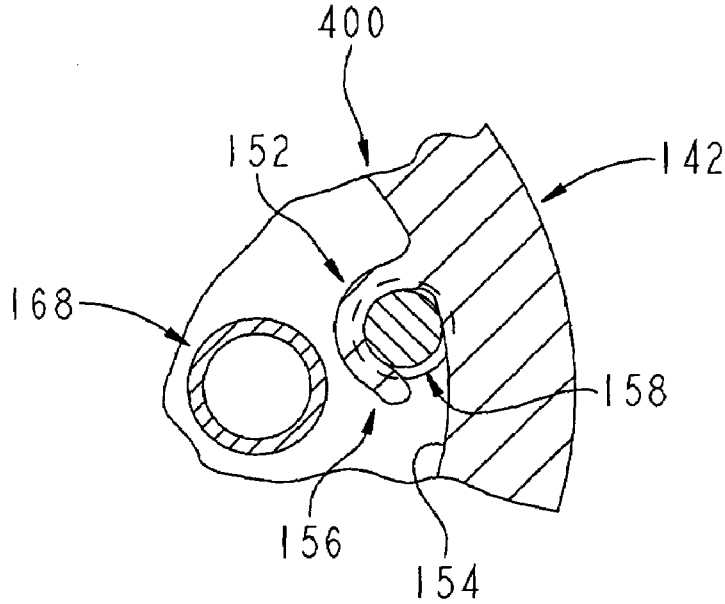
FIG. 15 is a top plan view of FIG. 14, showing the placement of the retainer member of the base member proximate to another component of valve body assembly, illustratively a nipple, to aid in the retainment of the electrical cable by retainer member.

Referring further to FIGS. 14 and 15, sleeve 160 is shown assembled with clip 152. In one embodiment, base member 142 is keyed such that base 142 assembles to other components of valve body assembly 104 in a particular orientation. In one illustrative embodiment, clip 152 is oriented when base member 142 is assembled such that clip 152 is adjacent to another component of valve body assembly 104, illustratively a mixed water outlet nipple 168. By placing clip 152 in close proximity with another component, such as nipple 168, the other component provides a second mechanism for insuring that electrical cable 130 remains retained by clip 152.

In alternative embodiments other types of holders may be used for first electrical holder 400, such as a plurality of projecting legs which orient cable 130 such that cable 130 has a generally serpentine path, or other suitable means for preventing or minimizing the movement of electrical cable 120, such as clamps.

Figure 3:
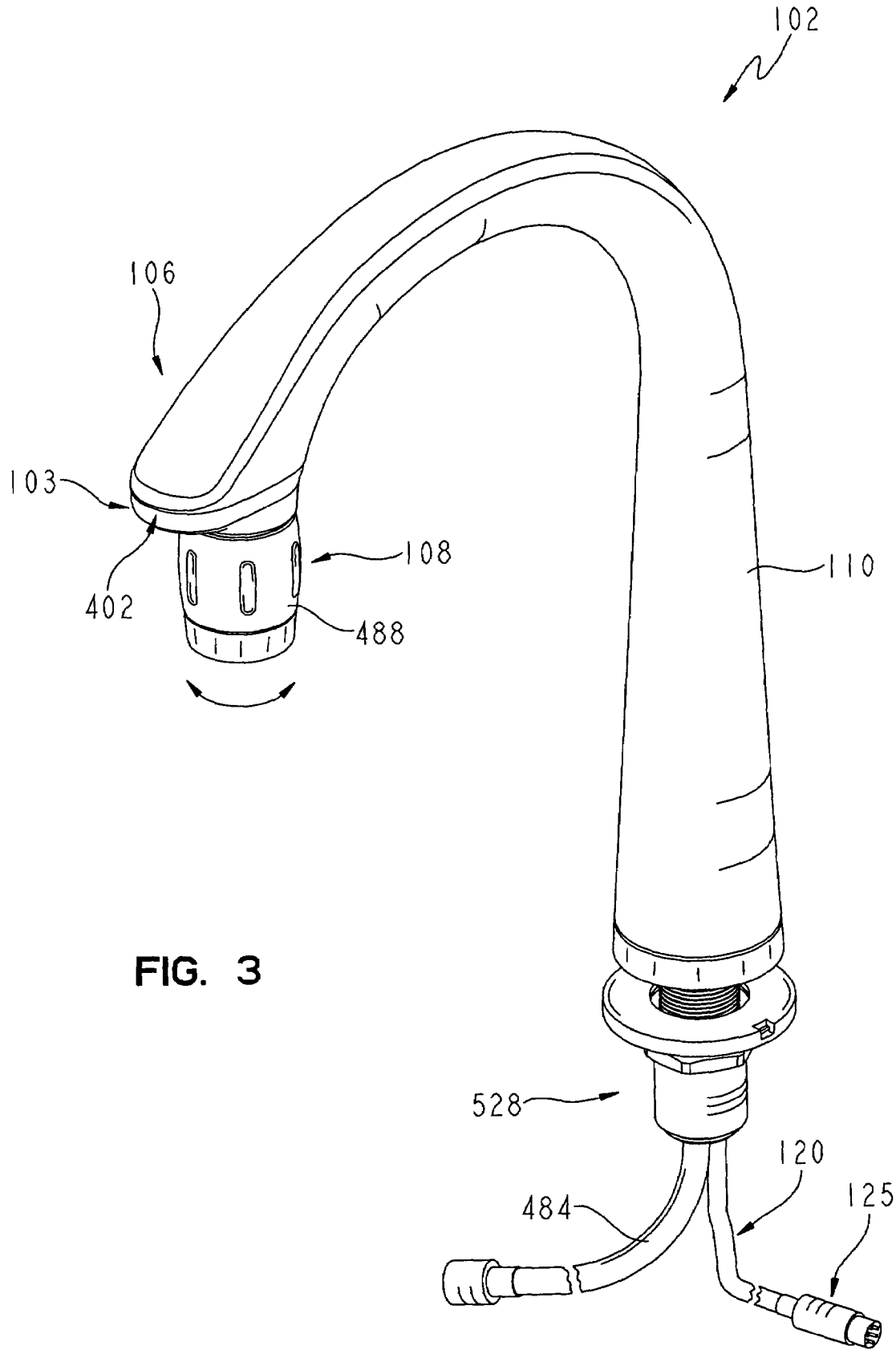
FIG. 3 is a top, front side perspective view of the spout assembly of FIG. 1.
Figure 5:
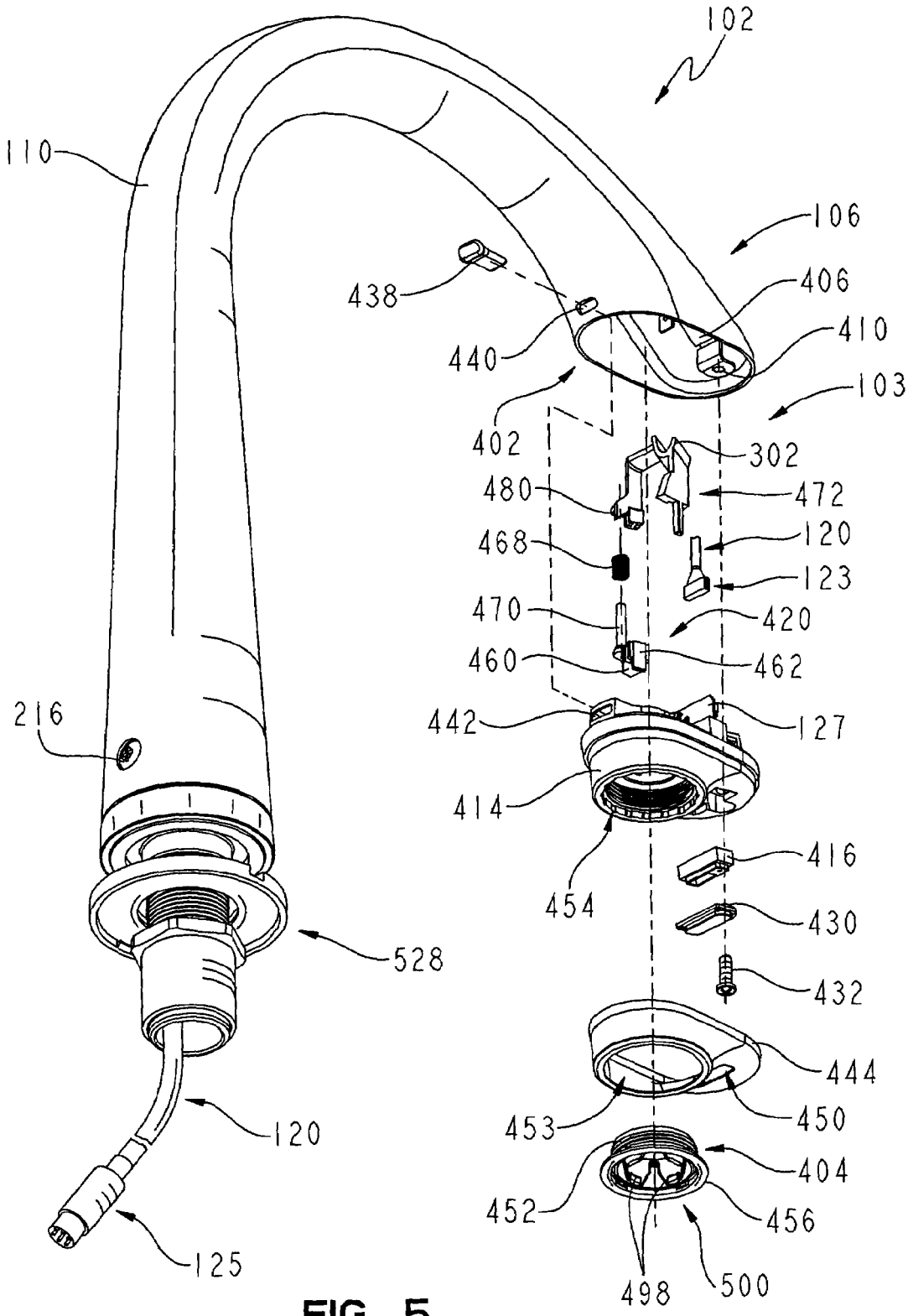
FIG. 5 is a bottom, rear perspective view of the spout assembly of FIG. 1, with a partial cut-away thereof and with the spray head removed for clarity, showing the sensor assembly and the spray head coupling exploded from the spout.
Figure 20:
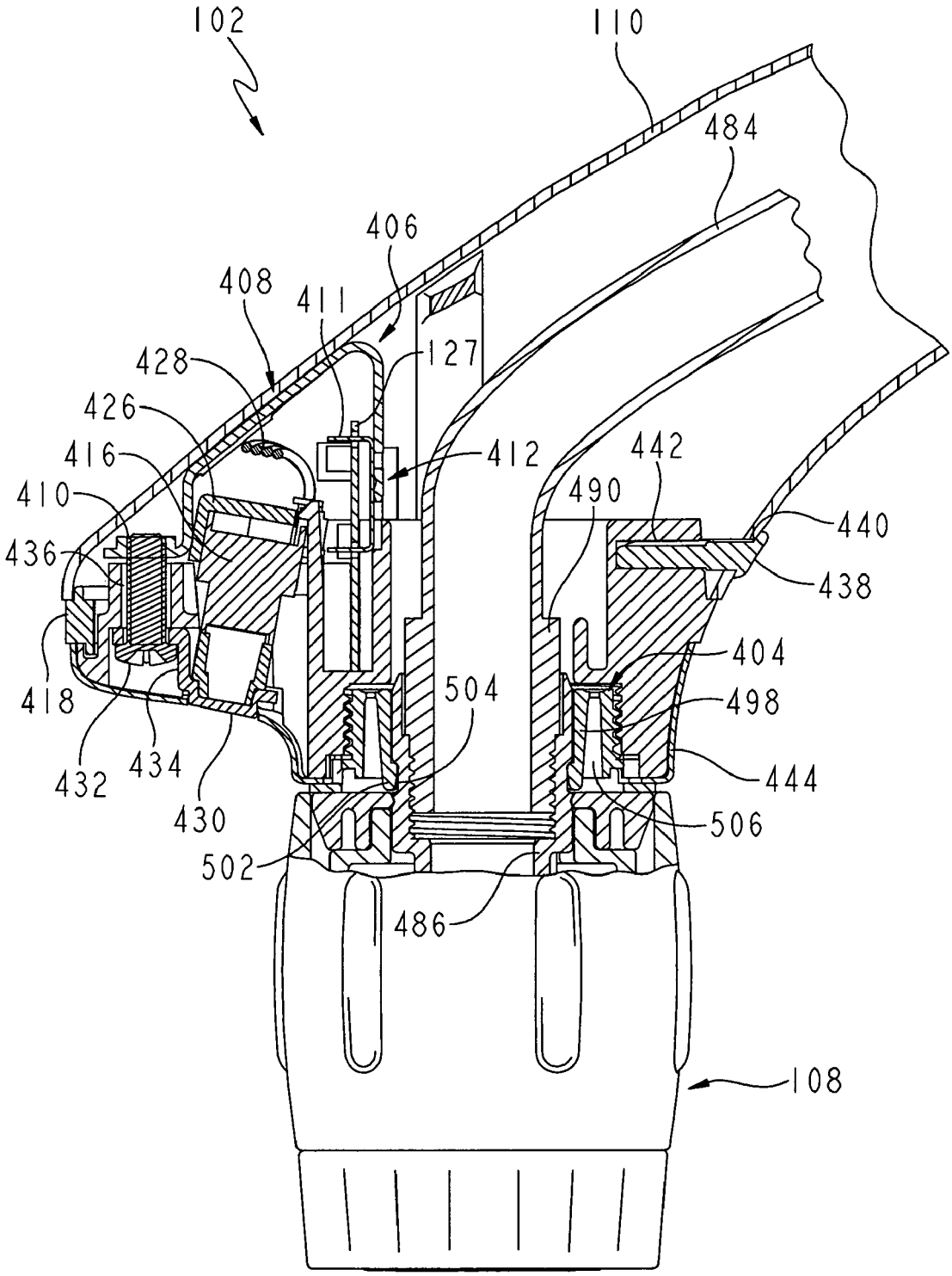
FIG. 20 is a cross-sectional view taken along line 20-20 of FIG. 19.
Figure 21:
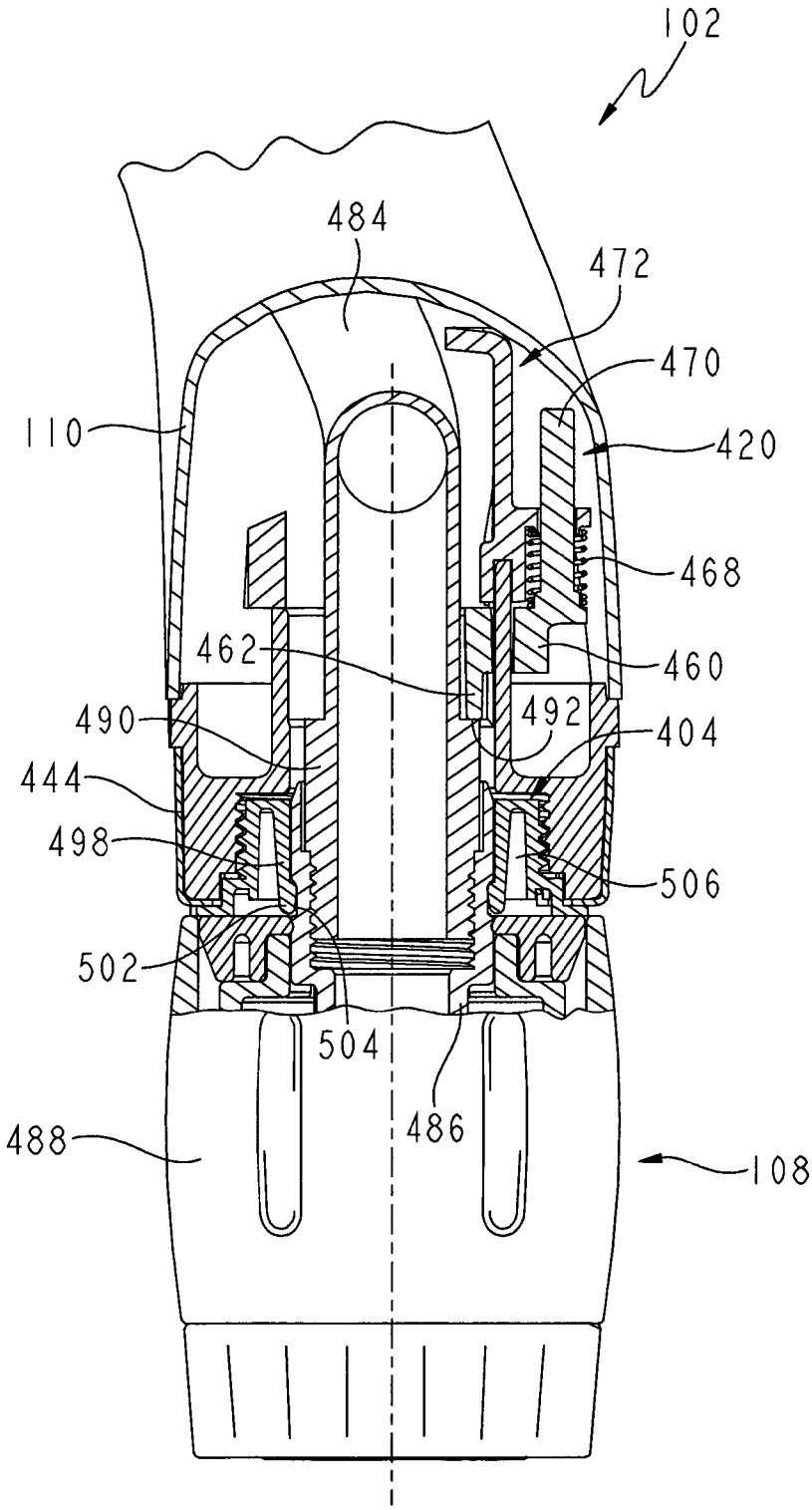
FIG. 21 is a cross-sectional view taken along line 21-21 of FIG. 19, showing the spray head coupled to the delivery spout.

With reference now to FIGS. 3-5, spout assembly 102 includes an outlet 402 formed in upper portion 106 which receives sensor assembly 103 and a retainer 404 for removably coupling spray head 108 to delivery spout 110. Sensor assembly 103 includes a bracket 406 which is mechanically and electrically connected to the delivery spout 110 at an interface 408 (FIG. 20). The bracket 406 may be coupled to the inner surface of the delivery spout 110 through conventional means, including brazing, welding, gluing or other similar methods. The bracket 406 has a threaded opening 410 at a first end and is in electrical communication with a circuit board 127 at a second end 412. The bracket 406 provides electrical communication between the delivery spout 110 and a capacitive sensor supported on the circuit board 127. More particularly, a connector 411 (FIG. 20) on the circuit board 127 engages with the second end 412 of the bracket 406. It should be noted that the combined delivery spout 110 and bracket 406 may be chrome plated or have another similar finish applied thereto.

With reference to FIGS. 4, 5, 16, and 17, sensor assembly 103 further includes a plastic holder 414 which supports the circuit board 127, an infra-red (IR) sensor 416, a light pipe 418, and a sliding member 420. The IR sensor 416 may be of the type detailed in one or more of the Related Applications including U.S. Provisional Patent Application Ser. No. 60/661,982, filed Mar. 14, 2005, titled "POSITION-SENSING DETECTOR ARRANGEMENT FOR CONTROLLING A FAUCET," the disclosure of which has been previously expressly incorporated by reference herein. A reflector 422 cooperates with the light pipe 418 and is configured to assist in directing light from light emitting diodes (LEDs) 423 to a forward projecting lens 424. More particularly, light pipe 418 butts up against LEDs mounted on the circuit board 127. Illustratively, when the system 100 is in a hands-free (IR) mode, the LEDs will flash in one color. Further illustratively, when the system 100 is in a touch mode, the LEDs will display a second color. The selected colors may be those available from any commercially available LED.

An insulator or gasket 426 isolates the IR sensor 416 from the spout bracket 406 to facilitate proper operation by eliminating undesired contact on the IR sensor 416. A cable assembly 428 provides electrical communication between the IR sensor 416 and the circuit board 127.

A lens 430 is coupled to the holder 414 by a conventional fastener, such as a threaded bolt 432, passing through an opening 434 formed in the lens 430 and an opening 436 formed within the holder 414. The fastener 432 is threadably received within the opening 410 of the bracket 406. In other words, the fastener 432 traps the lens 430 and engages with the threaded opening 410 of the bracket 406 to restrain the front end of the sensor assembly 103. A retention pin 438 is slidably received within an opening 440 formed in the delivery spout 110 and is received within a slot 442 of the holder 414 to secure the rear of the sensor assembly 103. A trim piece 444 may be received over the holder 414 for aesthetics. Retainer 404 is threadably received within a lower portion 448 of the holder 414 and retains the trim piece 444. The lens 430 is configured to project through an opening 450 of the trim piece 444 and protect the IR sensor 416. More particularly, the retainer 404 includes an externally threaded ring 452 which passes through an opening 453 of the trim piece 444 and is threadably received within an internally threaded opening 454 of the holder 414. An annular retaining lip 456 abuts the trim piece 444 and, as such, couples it to the holder 414.

Figure 16:
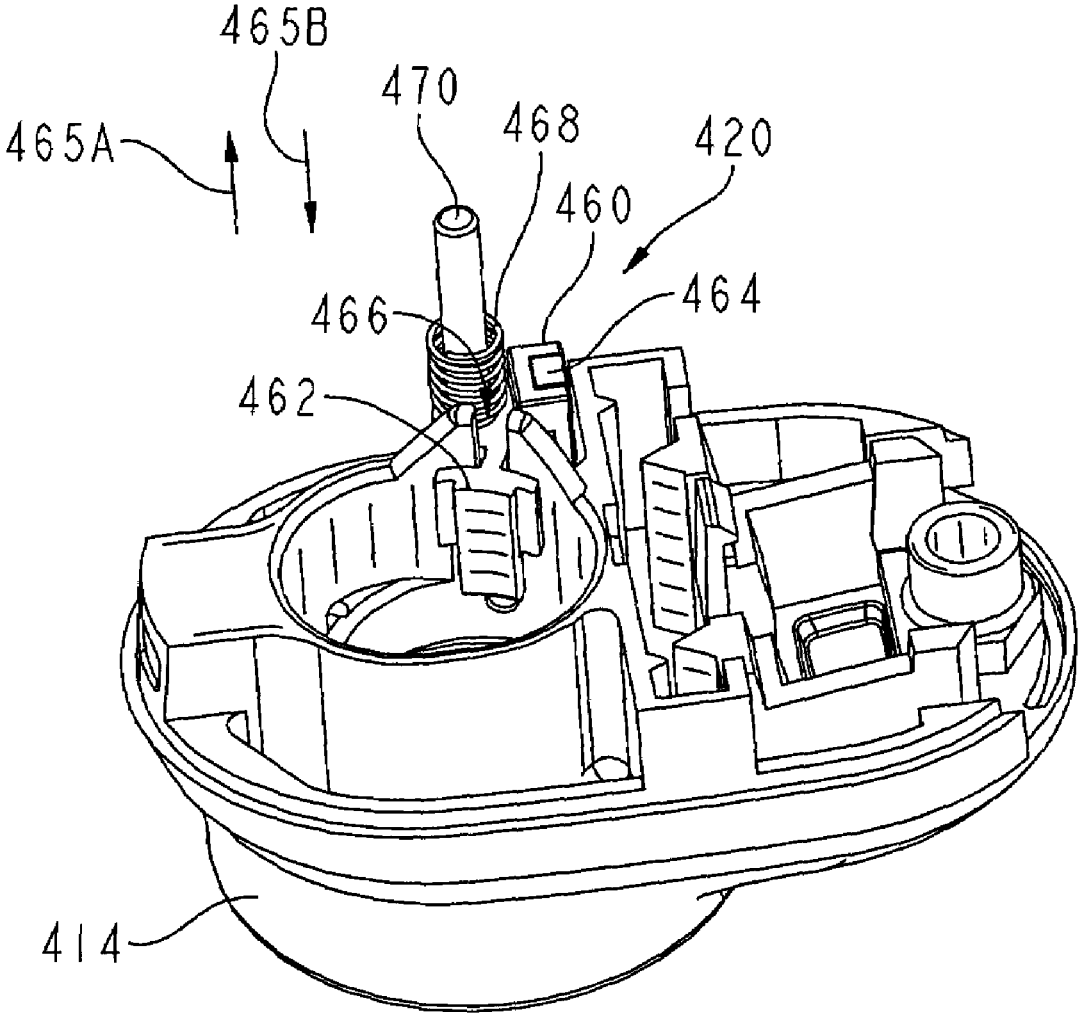
FIG. 16 is a perspective view of an illustrative embodiment sensor assembly of FIG. 4.
Figure 17:
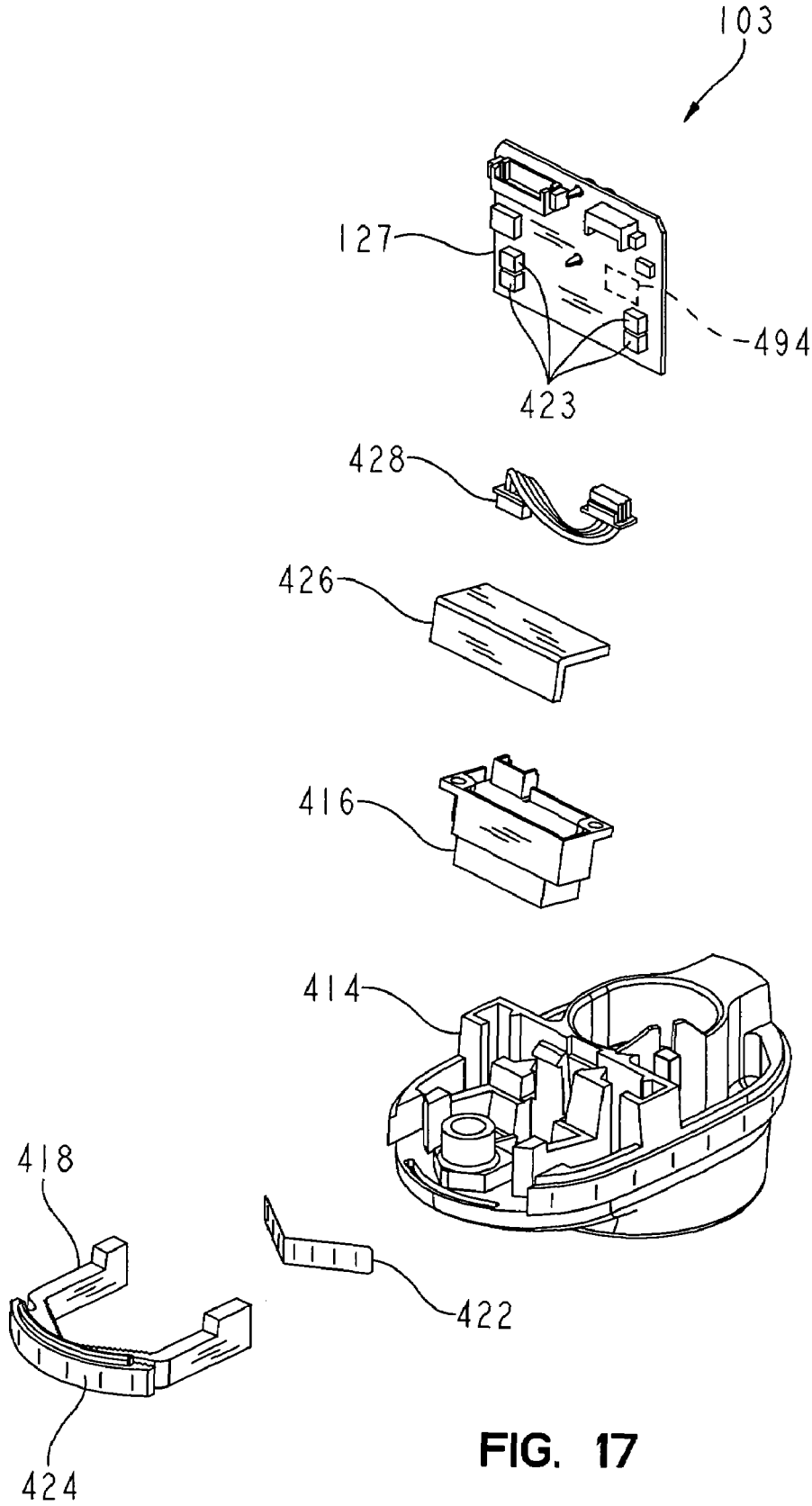
FIG. 17 is an exploded perspective view of the sensor assembly of FIG. 16.

The sliding member 420 is illustratively formed of a thermoplastic material and includes a holder 460 and a guide member 462. The holder 460 is configured to retain a sensing element, such as an embedded magnet 464 (FIG. 16). The guide member 462 is configured to slide in the direction of arrows 465A and 465B within a slot 466 formed within the holder 414. Illustratively, a biasing member, such as a spring 468 is configured to bias the sliding member 420 in a direction away (arrow 465B) from the outlet of the delivery spout 110. The spring 468 is illustratively supported on a post 470 formed integral with the sliding member 420, and extends between the guide member 462 and a support bracket 472.

The support bracket 472 is substantially U-shaped and includes upwardly extending first and second legs 474 and 476 supported by the holder 414. A connector 478 connects the first and second legs 474 and 476 and defines a second electrical holder 300, including cradle 302 for supporting electrical cable 120, as further detailed below. A tab 480 extends outwardly from the second leg 476 and includes an opening 482 for receiving the post 470 supporting spring 468.

A fluid conduit, illustratively a flexible hose 484 of conventional design is coupled to the spray head 108. The spray head 108 is of conventional design and includes a waterway 486 received within an outer housing or ring 488. As is known in the art, rotation of the outer housing 488 relative to the waterway 486 changes the flow of water between an aerated stream and a spray through operation of a diverter (not shown). A collar, illustratively a hose nut 490 engages with a lower surface 492 of the guide member 460 of the sliding member 420 as the spray head 108 is moved upwardly into its coupled position with the delivery spout 110. As may be appreciated, the hose nut 490 may be a separate element supported for movement with the spray head 108, or may be formed integral with the waterway 486 or the hose 484.

When the spray head 108 is coupled to the delivery spout 110, the sliding member 420 is pushed upwards by the hose nut 490. When the spray head 108 is uncoupled from the delivery spout 110, the sliding member 420 moves down due to gravity and biasing force exerted by the spring 468. The magnet 464 cooperates with a Hall effect sensor 494 mounted on the circuit board 127 to sense the relative position of the sliding member 420 and, as such, the spray head 108. In an illustrative embodiment, when the sensor 494 detects that the spray head 108 is uncoupled from the outlet of the delivery spout 110, the controller 116 instructs the valve 132 to automatically turn on the water flow. More particularly, in a further illustrative embodiment the Hall effect sensor 494 transmits a signal representative of the relative position of the spray head 108 to the controller 116, which, in response thereto, places the system 100 in a particular mode of operation (i.e. hands-free, touch, or manual).

The retainer 404 illustratively includes a plurality of inwardly extending arms 498 circumferentially spaced within the opening 500 defined by the threaded ring 452. The arms 498 are illustratively integrally formed with the threaded ring 452 and are biased inwardly. Tabs 502 are formed at the lower end of the arms 498 and are configured to engage an annular groove 504 formed within the waterway of the spray head 108. Engagement between the tabs 502 and the groove 504 couple the spray head 108 to the delivery spout 110. Retention is facilitated by the flexible nature of the arms 498. In the illustrative embodiment, an elastomer pad 506 is positioned radially outwardly from each arm 498 and is configured to assist in biasing the arms 504 inwardly. The elastomeric pads 506 provide extra compression set and creep resistance to the arms 498. If the arms 498 or trim piece 444 are damaged, the retainer 404 can be easily removed and either component replaced.

Figure 18:
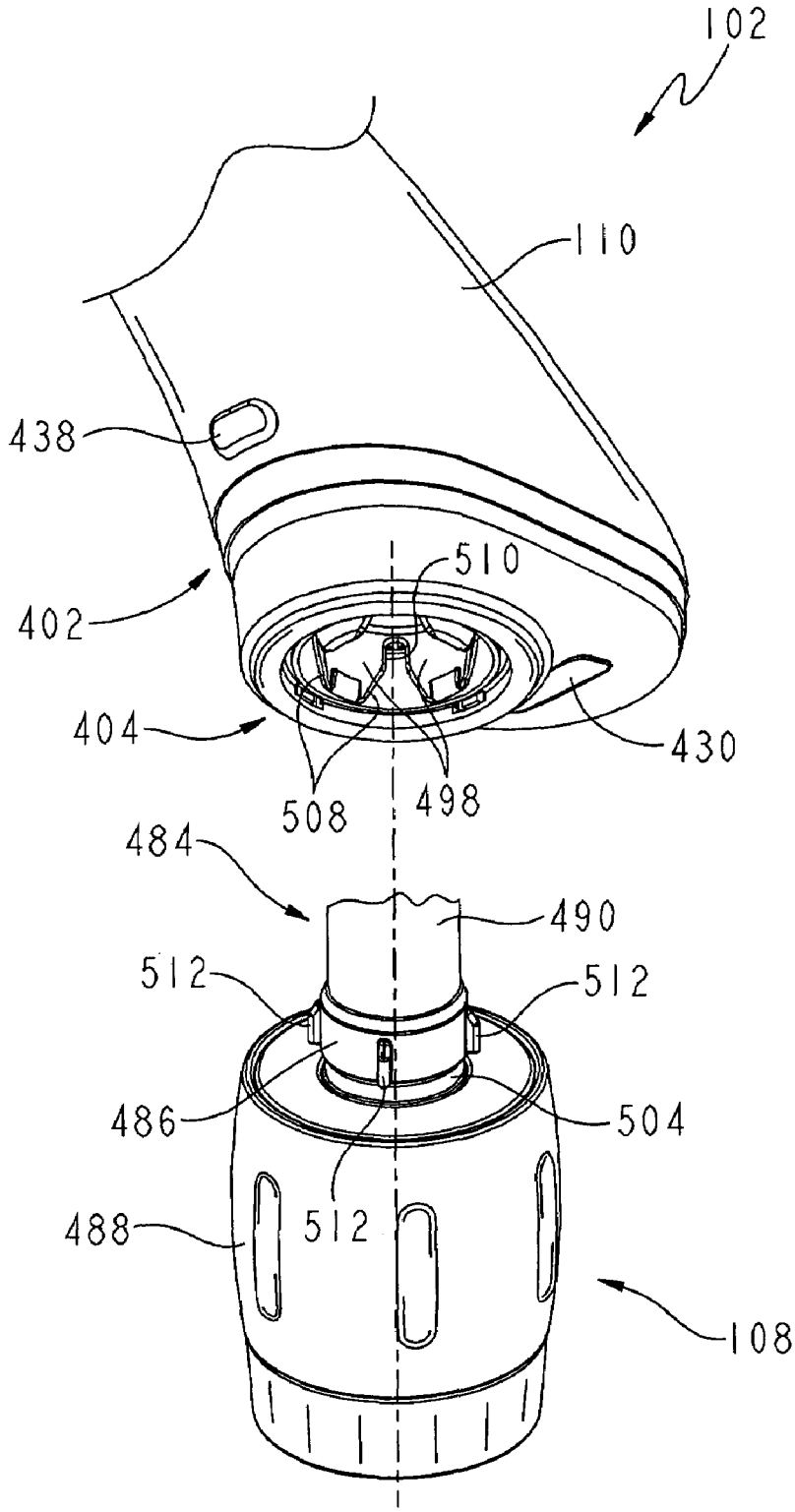
FIG. 18 is a perspective view of the spray head coupling of the spout assembly of FIG. 14, with a cut-away of the fluid conduit for clarity.
Figure 19:
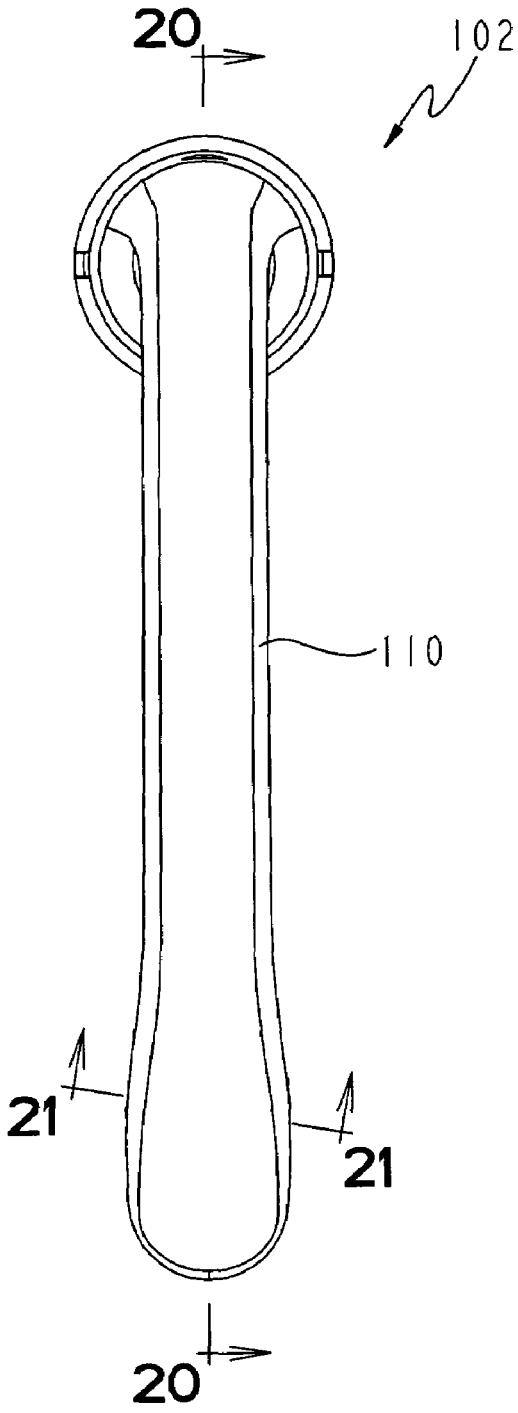
FIG. 19 is a top plan view of the spout assembly of FIG. 1.

With reference to FIG. 18, the retainer 404 illustratively includes four circumferentially spaced arms 498, although the number and spacing of the arms 498 may vary. The sides of the arms 498 include chamfered surfaces 508 to provide easy docking of the spray head 108. A straight land area 510 of each arm 498 is configured to engage with an adjacent tab or rib 512 formed on the waterway 486 of the spray head 108. The engagement between the areas 510 and the ribs 512 prevents relative rotation between the waterway 486 of the spray head 108 and the retainer 404. As such, a rotation of the outer housing 488 of the spray head 108 is resisted by the waterway 486, such that relative rotation occurs between outer housing 488 and waterway 486. This allows the conventional diverter to change fluid flow between an aerated stream to a spray in response to rotation of the outer housing.

Figure 23:
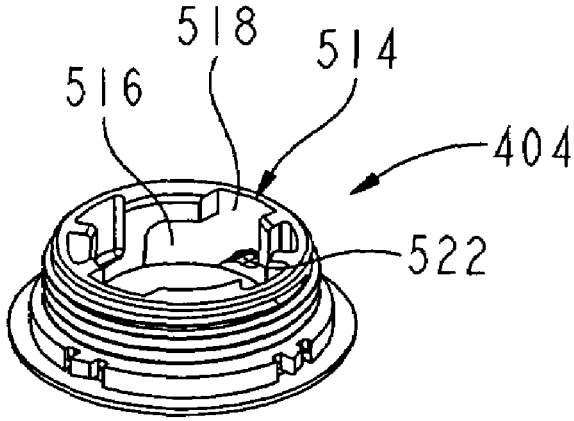
FIG. 23 is a perspective view of a further illustrative embodiment spray head coupling, showing the spray head uncoupled from the delivery spout.
Figure 23:
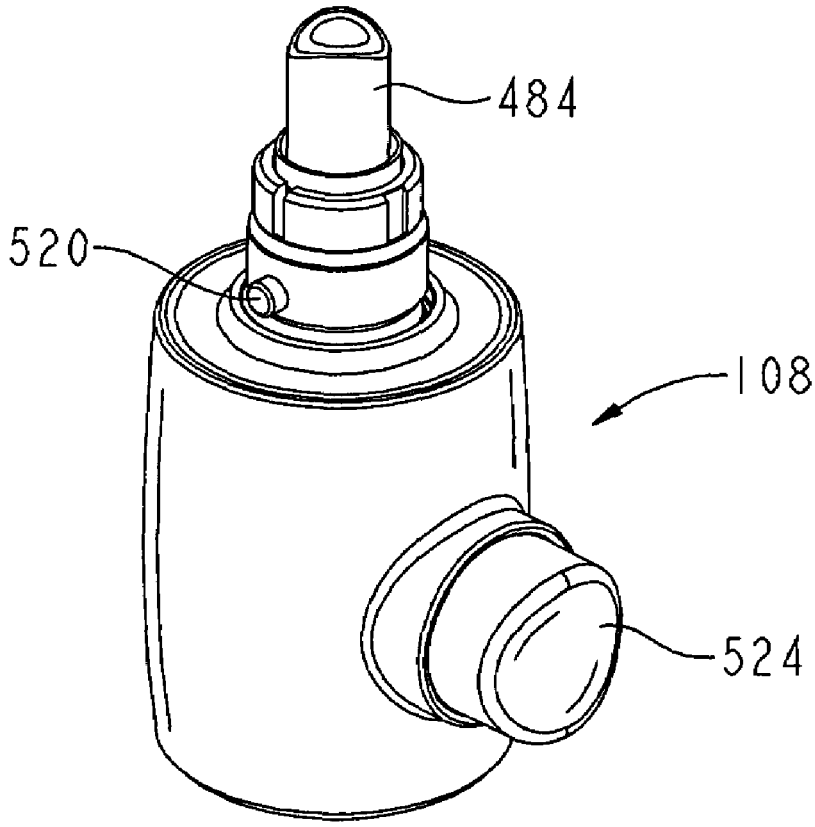

While the illustrative embodiment retainer 404 utilizes circumferentially spaced, inwardly biased arms 498 to couple the spray head 108 to the delivery spout 110, it should be appreciated that other couplers may be substituted therefor. For example, a conventional bayonet coupler or retainer 404', as shown in FIG. 23, may be used to couple the spray head 108 to the delivery spout 110. More particularly, the retainer 404' illustratively includes a slot 514 including a circumferential portion 516 and an axial portion 518. The slot 514 is configured to receive a pin 520 supported by the waterway hose 484 at the spray head 108'. Pin 520 of spray head 108' is inserted into circumferential portion 516 of slot 514 and then moved upwardly and rotated until it is axially locked by a retaining surface 522. Operation of the diverter (not shown) to toggle water flow between a stream and a spray is controlled by a push button 524.

With reference now to FIGS. 7 and 10, spout hub 218 is received within the lower portion 112 of spout 110. Illustratively the spout hub 218 is formed of brass and secured to spout 110 in a conventional manner, for example through brazing. A valve body assembly 528 is illustratively removably received within the spout hub 218 for securing the spout assembly 102 to the sink deck 105. The valve body assembly 528 illustratively includes a valve body 530 formed of a metal, such as brass, and including a threaded portion 532 configured to receive a securing nut 534.

A base 536, illustratively formed of a plastic, is received around the valve body 530 and is supported above the sink deck 105. A sealing gasket 538, illustratively formed of a resilient material, is positioned intermediate the base 536 and the sink deck 105. A mounting washer 540 and an isolator 542 are secured below the sink deck 105 by the securing nut 534. More particularly, the sink deck 105 is clamped between the base 536 and the isolator 542 by the securing nut 534, thereby securing the spout assembly 102 to the deck 105. A friction spacer 544 is positioned on valve body 530 and is frictionally received within the spout hub 218. An electrical clip 546 is received around the valve body 530 and provides electrical communication between valve body 530 and spout hub 218. If electrical communication (or isolation) between valve body 530 and the capacitance touch sensor is inconsistent, "false touch events" may occur due to unintended, and typically sporadic, electrical isolation (or communication). By maintaining electrical communication between valve body 530 and spout hub 218, and hence spout 110 and capacitance touch sensor through brackets 306, such instances of "false touch events" may be reduced or eliminated.

Although the invention has been described in detail with reference to certain preferred embodiments, variations and modifications exist within the spirit and scope of the invention as described and defined in the following claims.

The invention claimed is:

1. An electronic faucet assembly, comprising:

a spout assembly including an electronic sensor positioned proximate an upper portion of the spout assembly and an electrical cable running through an interior of the spout assembly from a lower portion to the upper portion, the lower portion including a spout hub, the electrical cable being operably coupled to the electronic sensor; and a cable holder positioned proximate to the lower portion of the spout assembly and coupled to the spout assembly, the cable holder vertically oriented within the spout assembly, the cable holder including a lower cable holder portion and an upper cable holder portion including a base member and a plurality of legs extending from the base member, the plurality of legs being vertically spaced apart within the spout assembly, wherein each of the plurality of legs includes a tab projecting outward to a side of each of the plurality of legs, the tabs arranged, in an alternating fashion, the lower cable holder portion including a finger extending from the base and having an attachment member affixed to the spout hub;

the cable holder being configured to hold a first portion of the electrical cable to provide strain relief against an external force on a second portion of the electrical cable more distal from the spout assembly than the first portion and to generally compress the electrical cable within the interior of the spout assembly to reduce unintended movement of the electrical cable within the interior of the spout assembly;

each tab configured to restrict movement of the electrical cable to within the longitudinal length of each of the plurality of legs.

2. The electronic faucet assembly of claim 1, further comprising a second cable holder positioned proximate to the upper portion of the spout assembly, the second cable holder being configured to hold a third portion of the electrical cable.

3. The electronic faucet assembly of claim 2, wherein the second cable holder includes a cradle configured to capture the electrical cable against an inner surface of the spout assembly.

4. The electronic faucet assembly of claim 1, wherein the first cable holder holds the first portion of the electrical cable such that the first portion of the electrical cable has a serpentine appearance.

5. The electronic faucet assembly of claim 1, wherein the electronic sensor includes an infrared sensor configured to detect the presence of a user's hands.

6. The electronic faucet assembly of claim 1, further comprising:

a pull-out spray head removably coupled to an outlet of the spout assembly; and wherein the electronic sensor is configured to detect a position of the spray head relative to the outlet of the spout assembly.

7. An electronic faucet assembly, comprising:

a spout assembly including a delivery spout and a spout hub positioned at an inlet of the delivery spout, a pull-out spray head removably coupled to an outlet of the delivery spout, an electronic sensor supported by the delivery spout, and an electrical cable extending through an interior of the delivery spout and operably coupled to the electronic sensor; and a cable holder supported within the interior of the delivery spout, the cable holder including a base and a finger extending from the base and having an attachment member affixed to the spout hub of the spout assembly, the cable holder oriented in a substantially vertical orientation, the cable holder including a plurality of legs, the plurality of legs spaced apart and engaging the electrical cable, wherein each of the plurality of legs includes a tab projecting outward to a side of each of the plurality of legs, the tabs arranged in an alternating fashion, the cable holder configured to hold a first portion of the electrical cable to provide strain relief against an external force on a second portion of the electrical cable more distal from the spout assembly than the first portion.

8. The electronic faucet assembly of claim 7, wherein the cable holder is further configured to generally compress the electrical cable within the interior of the delivery spout to reduce unintended movement of the electrical cable within the interior of the spout assembly.

9. The electronic faucet assembly of claim 7, further comprising a second cable holder positioned proximate to an upper portion of the delivery spout, the second cable holder being configured to hold a third portion of the electrical cable.

10. The electronic faucet assembly of claim 9, wherein the second cable holder includes a cradle configured to capture the electrical cable against an inner surface of the delivery spout.

11. The electronic faucet assembly of claim 7, wherein the first cable holder holds the first portion of the electrical cable such that the first portion of the electrical cable has a serpentine appearance.

12. The electronic faucet assembly of claim 7, wherein the electronic sensor includes an infrared sensor configured to detect the presence of a user's hands.

13. The electronic faucet assembly of claim 7, and wherein the electronic sensor is configured to detect a position of the spray head relative to the outlet of the delivery spout.

14. The electronic faucet assembly of claim 7, wherein the cable holder includes:

a lower portion configured to be coupled to an inner surface of the delivery spout; and an upper portion for engaging the first portion of the electrical cable, the upper portion including the plurality of legs which cooperate to provide the first portion of the electrical cable with a serpentine path.

* * * * *

UNITED STATES PATENT AND TRADEMARK OFFICE

CERTIFICATE OF CORRECTION

PATENT NO. : 7,631,372 B2
APPLICATION NO. : 11/325284
DATED : December 15, 2009
INVENTOR(S) : Marty et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 833 days.

Signed and Sealed this

Second Day of November, 2010

David J. Kappos

David J. Kappos
*Director of the United States Patent and Trademark Office*